US007088315B2

(12) United States Patent
Suzuki et al.

(10) Patent No.: US 7,088,315 B2
(45) Date of Patent: Aug. 8, 2006

(54) PLASMA DISPLAY DEVICE HAVING AN IMPROVED CONTRAST RADIO

(75) Inventors: Keizo Suzuki, Kodaira (JP); Shirun Ho, Tokyo (JP); Masatoshi Shiiki, Musashimurayama (JP); Tatsuya Miyake, Hatoyama (JP); Kenichi Yamamoto, Higashimurayama (JP)

(73) Assignee: Hitachi, Ltd., Tokyo (JP)

( * ) Notice: Subject to any disclaimer, the term of this patent is extended or adjusted under 35 U.S.C. 154(b) by 339 days.

(21) Appl. No.: 10/646,706

(22) Filed: Aug. 25, 2003

(65) Prior Publication Data

US 2005/0007308 A1 Jan. 13, 2005

(30) Foreign Application Priority Data

Jul. 8, 2003 (JP) ..... 2003-193765

(51) Int. Cl.
*G09G 3/28* (2006.01)

(52) U.S. Cl. ..... 345/60; 345/63; 345/211

(58) Field of Classification Search ..... 345/41, 345/62, 65, 60, 63, 211–213; 315/169.1, 315/169.2, 169.3
See application file for complete search history.

(56) References Cited

U.S. PATENT DOCUMENTS

2004/0061669 A1* 4/2004 Kang et al. ..... 345/60
2004/0196216 A1* 10/2004 Shindo et al. ..... 345/60

FOREIGN PATENT DOCUMENTS

JP 8-329843 12/1996

OTHER PUBLICATIONS

High-Resolution Interlaced Addressing for Plasma Displays, 1999 SID International Symposium Digest of Technical Papers, vol. XXX, 14.1, 1999, pp. 154-157.
Ultraviolet Production Efficiency of AC-PDPs and Ways to Increase It, 3rd International Conference on Atomic and Molecular Data and Their Applications ICAMDATA, AIP Conference Proceedings, vol. 636, 2002, pp. 75-84.
Theoretical formulation of the VUV production efficiency in a plasma display panel, J. Appl. PHys., vol. 88, 2000, pp. 5605-5611.

* cited by examiner

*Primary Examiner*—Sumati Lefkowitz
*Assistant Examiner*—Donna Lui
(74) *Attorney, Agent, or Firm*—Mattingly, Stanger, Malur & Brundidge, P.C.

(57) ABSTRACT

A plasma display device is realized which has a high set-luminous-efficacy (i.e. provides a high-brightness display image at a low power consumption) and a high light-room contrast. The luminous efficacy hs and the display discharge voltage Vs are increased by increasing the product pd in discharge, or increasing the Xe proportion aXe of the discharge. As a result the display-discharge region area ratio Ad and the display region reflectance β can be reduced by reducing the display-electrode area Sse approximately in inverse proportion to $Vs^2$, and thereby the set-luminous efficacy hs and the set luminance Bpons and the light-room contrast Cb are increased.

32 Claims, 12 Drawing Sheets

PLASMA DISPLAY DEVICE HAVING AN IMPROVED CONTRAST RADIO

BACKGROUND OF THE INVENTION

1. Field of the Invention

The present invention relates to a plasma display device employing a plasma display panel (hereinafter also referred to as a plasma panel or a PDP) and an image display system using the plasma display device. In particular, the present invention is useful for providing a display device capable of improving luminous efficacy and producing a high-contrast and high-quality image.

2. Description of Prior Art

Recently, plasma display devices have been expected as promising large-size thin color display devices. More specifically, an ac surface-discharge type PDP is the most common type among PDPs put to practical use because of its simple structure and high reliability. Although the present invention will be explained mainly by using a conventional PDP of the ac surface-discharge type, the present invention is equally applicable to other types of PDPs.

FIG. 2 is an exploded perspective view illustrating a part of a structure of an example of a plasma panel. Formed on an underside of a front glass substrate (a substrate facing a viewing space explained subsequently) 21 are transparent common electrodes (hereinafter referred to as X electrodes) 22-1, 22-2 and transparent independent electrodes (hereinafter referred to as Y electrodes or scan electrodes) 23-1, 23-2. X bus electrodes 24-1, 24-2 and Y bus electrodes 25-1, 25-2 are overlaid on the X electrodes 22-1, 22-2 and the Y electrode 23-1, 23-2, respectively. Further, the X electrodes 22-1, 22-2 and the Y electrodes 23-1, 23-2, the X bus electrodes 24-1, 24-2, and the Y bus electrodes 25-1, 25-2 are covered with an dielectric 26, and then are covered with a protective film (also called a protective layer) 27 such as magnesium oxide (MgO). The X electrodes 22-1, 22-2 and the Y electrodes 23-1, 23-2, the X bus electrodes 24-1, 24-2, and the Y bus electrodes 25-1, 25-2 are collectively named a display discharge electrode or a display electrode (a display discharge electrode pair or a display electrode pair when a pair of X and Y electrodes is indicated).

In the above, the X electrodes 22-1, 22-2 and the Y electrodes 23-1, 23-2 have been explained as transparent electrodes, this is because a lighter (high-brightness) panel can be obtained, and it is needless to say that they do not always need to be transparent. Magnesium oxide (MgO) is explained as a concrete material for the protective film 27, but material for the protective film 27 is not limited to magnesium oxide. The objects of the protective film 27 are to protect the display discharge electrodes and the dielectric 26 from bombarding ions and to promote initiation and sustenance of discharge with secondary electron emission caused by incident ions. Other materials can be used which are capable of achieving the above objects. The front glass substrate 21 combined in this way with the electrodes, the dielectric, the protective films in an integral structure is called a front plate.

On the other hand, formed on an upside of a rear glass substrate 28 are electrodes (hereinafter referred to as A electrodes or address electrodes) 29 such that they intersect the X electrodes 22-1, 22-2 and the Y electrodes 23-1, 23-2 at right angles with grade separation. The A electrodes 29 are covered with a dielectric 30, and barrier ribs 31 are formed on the dielectric 30 such that they extend in parallel with the A electrodes 29. Further, phosphors 32 are coated on inner surfaces of cavities formed by wall surface of the barrier ribs 31 and the upper surfaces of the dielectric 30. The rear glass substrate 28 combined in this way with the A electrodes and the dielectric in an integral structure is called a rear plate.

A plasma panel is fabricated by bonding the front and rear plates provided with the necessary constituent elements as described above, filling a gas (a discharge gas) for creating plasma, and then sealing the panel. It is needless to say that it is necessary to bond and seal the front and rear plates to ensure the hermeticity of the sealed package containing the discharge gas.

FIG. 3 is a cross-sectional view of the PDP of FIG. 2 viewed in the direction of the arrow D1 of FIG. 2, and schematically illustrates one cell which serves as the smallest picture element with borders of the one cell roughly indicated by broken lines. Hereinafter, cells are also called discharge cells.

In FIG. 3, the A electrode 29 is disposed halfway between the two barrier ribs 31, and the gas (discharge gas) for creating the plasma is contained within a discharge space 33 surrounded by the front glass substrate 21, the rear glass substrate 28 and the barrier ribs 31.

Here, the discharge space means a space where a display discharge, an address discharge, or a preliminary discharge (also called a reset discharge) is generated in operation of the plasma panel as described later. More specifically, the discharge space is a space which is filled with the discharge gas, has applied thereacross an electric field necessary for the discharge, and has a spatial expanse required for generation of the discharge. Further, a display discharge space means a space where a display discharge occurs, more specifically, a space which is filled with the discharge gas, has applied thereacross an electric field necessary for a display discharge, and has a spatial expanse required for generation of the display discharge. The discharge space and the display discharge space mean a space included in each of the discharge cells, or a collection of the spaces included in the discharge cells.

In a color PDP, usually three kinds of phosphors for red, green and blue are coated within the cells. A trio of cells coated with the three different kinds of phosphors serve as one pixel. A space having a plurality of such cells or pixels arranged continuously and periodically is called a display space. A set is called a plasma display panel or plasma panel which includes the display space and is provided with other necessary structures such as vacuum sealing and electrode leads for external connection. Hereinafter, the plasma panel is also referred to as the PDP.

In the plasma panel, a structure integrally fabricated to seal the discharge gas therein hermetically is referred to as the basic plasma panel. In the basic plasma display panel, a surface from which visible light for display is irradiated is called a display surface, and a space into which the visible light for display is irradiated is called a viewing space.

As described above, in the basic plasma panel, there is a space containing the plural discharge cells arranged continuously, which is hereinafter referred to as a display space. A projection of the display space onto the display surface is called a display region Rp, a projection of the discharge space onto the display surface is called a discharge region, and a projection of the display discharge space onto the display surface is called a display discharge region. A region other than the display discharge region in the display region Rp is called a non-display discharge region. A projection of the discharge cell onto the display surface is called a cell region.

A direction perpendicular to the display surface is called a height direction. In a case where the discharge cells include barrier ribs as their constituent components, a direction of a line connecting centers of two adjacent ones of the discharge cells arranged with one of the barrier ribs interposed therebetween is called a width direction, and a direction perpendicular to the width direction in a plane parallel with the display surface is called a length direction.

A barrier rib width is defined as a width of the barrier rib as measured in the width direction, and an average of the barrier rib width averaged over the height direction of the barrier rib is called an average barrier rib width Wrba.

In the conventional plasma panel shown in FIG. 2, the length directions of the barrier ribs are oriented approximately in one direction, and this structure of the plasma panel is called the straight-barrier-rib structure. In another conventional plasma panel, the length directions of the barrier ribs are oriented in at least two directions, that is, DR1 and DR2, and this structure of the plasma panel is called the box-barrier-rib structure.

FIG. 4 is a cross-sectional view of the PDP of FIG. 2 viewed in the direction of the arrow D2 of FIG. 2, and schematically illustrates one cell with borders of the one cell roughly indicated by broken lines. Reference character Wgxy denotes a spacing between the display electrode pair (the X and Y electrodes), and the spacing Wgxy is called a display electrode gap. In FIG. 4, reference numeral 3 denote electrons, 4 is a positive ion, 5 is a positive wall charge, and 6 are negative wall charges.

By way of example, FIG. 4 schematically illustrates that, by applying a negative voltage to the Y electrode 23-1 and a voltage positive with respect to the Y electrode 23-1 to the A electrode 29 and the X electrode 22-1, initially a discharge is generated, and then the discharge has ceased. This has caused formation of a wall charge for assisting in initiation of a discharge between the Y electrode 23-1 and the X electrode 22-1, and this formation of the wall discharge is called address. In this state, when an appropriate voltage of the polarity opposite from the previous one is applied between the Y electrode 23-1 and the X electrode 22-1, a discharge is generated in the discharge space between the two electrodes through the dielectric 26 (and the protective film 27). After the cessation of the discharge, if the polarity of the voltage applied between the Y electrode 23-1 and the X electrode 22-1 is reversed, a new discharge is generated again. By repeating this process, discharges are generated continuously, and these discharges are called display discharges (or sustain discharges).

FIG. 5 is a block diagram illustrating an image display system including a plasma display device employing a PDP and a video signal source coupled thereto. A driving means (also called a drive circuit) receives signals representing a display scene from the video signal source, and then converts the signals into drive signals for the PDP in a procedure explained below and drives the PDP.

FIGS. 6A–6C illustrate an operation during one TV field (hereinafter also called simply one field) required for displaying one picture on the PDP shown in FIG. 2. FIG. 6A is a time chart. As shown in portion (I) of FIG. 6A, one TV field 40 is divided into sub-fields 41 to 48 each having a different number of plural light emission times. Gray scales are generated by lighting one or more selectively from among the sub-fields.

As shown in portion II of FIG. 6A, each sub-field comprises a preliminary discharge period 49, an address discharge period 50 for addressing discharge cells to be lighted, and a display period (also called a lighted display period) 51.

The preliminary discharge period 49 is a period for homogenizing conditions of all the cells (conditions for establishing their drive characteristics) and preparing to ensure stability and reliability in their subsequent operations. Usually, during the preliminary discharge period, a preliminary discharge, a reset discharge, or an overall-address discharge (a discharge for addressing the entire display region simultaneously) is performed.

FIG. 6B illustrates waveforms of voltages applied to the A electrode, the X electrode and the Y electrode during the address discharge period 50 shown in FIG. 6A. A waveform 52 represents a voltage V0 (V) applied to one of the A electrodes during the conventional address discharge period 50, a waveform 53 represents a voltage V1(V) applied to the X electrode, and waveforms 54 and 55 represent voltages V2(V) applied to ith and (i+1)th Y electrodes. When a scan pulse 56 is applied to the ith Y electrode (in FIG. 6B, the scan pulse is illustrated as ground potential, but it may be selected to be a negative voltage), an address discharge is generated in a cell located at an intersection of the ith Y electrode with the address electrode 29. Even when the scan pulse 56 is applied to the ith Y electrode, if the A electrode 29 is at ground potential, the address discharge is not generated.

In this way, each of the Y electrodes is supplied with the scan pulse once during the address discharge period 50, and the A electrodes 29 are supplied with the voltage V0 or ground potential in synchronism with the scan pulse according to whether they are to be lighted or not to be lighted, respectively. In the discharge cells where the address discharges have been generated, electric charges are formed by the discharges on the surfaces of the dielectric and the protective films covering the Y electrodes. ON and OFF of the display discharge described subsequently are controlled by the assistance of an electric field generated by the above-mentioned electric charge. That is to say, the cells which have generated the address discharge serve as lighted cells, and the remainder of the cells serve as non-lighted cells.

On the other hand, there is another driving method in which the cells which have generated the address discharge serve as non-lighted cells (in which a wall charge generated by the above-explained overall-address discharge is eliminated by the address discharge), and in which the remainder of the cells serve as lighted cells.

FIG. 6C illustrates display discharge pulses applied between the X and Y electrodes which serve as display electrodes (also called display discharge electrodes) all at the same time during the display period 51 shown in FIG. 6A. The X and Y electrodes are supplied with the voltage waveforms 58 and 59, respectively.

The pulses of the magnitude V3 (V) and the same polarity are applied alternately to the X electrodes and the Y electrodes, and as a result reversal of the polarity of the voltage between the X and Y electrodes is repeated. The discharge occurring in the discharge gas between the X and Y electrodes during this period is called the display discharge. Here, display discharges occur in pulses, and their polarities are alternated.

A display electrode-to-electrode voltage Vse(t) externally applied in a cell during the display period is expressed by $$Vse(t)=Vy(t)-Vx(t) \quad (1)$$

where Vx(t) and Vy(t) are voltage applied to the X and Y electrodes, respectively, during the display period, and t represents time.

A maximum applied display-discharge voltage Vsemax is defined as the maximum of the absolute value |Vset(t)| of the display electrode-to-electrode voltage Vse(t) during a time when the display discharge pulses are applied. In FIG. 6C, Vsemax is V3 (V). However, in a case where the waveshape of the voltage actually applied to the display electrodes is distorted by capacitances, inductances and resistances and others included in circuits on route from the power supply to the plasma panel, and consequently, is not rectangular unlike in the case of FIG. 6C, V3 represents the display electrode voltage averaged over a time when the display discharge pulses are applied, and therefore Vsemax has a magnitude somewhat different from that of V3.

Usually the means for generating the display discharge pulses is provided in the drive means shown in FIG. 5. FIG. 7 illustrates its outline. The means for generating the display discharge pulses includes as its constituent elements dc voltage supplying means, that is, display-discharge dc power supplies, and switch circuits (circuits X, Y in FIG. 7) provided between the display-discharge dc power supplies and the display electrodes. The display-discharge dc power supplies may be formed of mere capacitors, or may be formed of mere grounding electrodes (grounding interconnection lines). The switch circuits serve to select voltages from among output voltages of the display-discharge dc power supplies including ground potential and apply the selected voltages to the display electrodes. A display-discharge dc power supply voltage Vsdc is defined as the maximum of the absolute value of a difference between two output voltages from the two display-discharge dc power supplies, respectively. The display-discharge dc power supply voltage Vsdc is approximately equal in magnitude to V3. However, in a case where the waveshape of the voltage actually applied to the display electrodes is distorted by capacitances, inductances and resistances and others included in circuits on route from the power supply to the plasma panel, and consequently, is not rectangular unlike in the case of FIG. 6C, Vsdc has a magnitude somewhat different from that of V3.

In the above explanation, the display discharge has been explained in connection with a driving system in which the address discharge periods and the display periods are separated from each other, that is, the Address and Display Periods Separated Driving System, but the essence of the display discharge lies in intentional generation of light emission necessary for display, and therefore it is needless to say that such a discharge is recognized as the display discharge in other driving systems also.

For example, in the above-explained driving system (the Address and Display Periods Separated Driving System), the address discharge periods and the light-emission display periods are provided for the entire display region simultaneously, respectively. However, there is another driving system in which, while the address discharge periods are provided to some of the scanning electrodes (the Y electrodes), the light-emission display periods are provided to others of the scanning electrodes (the Y electrodes), and vice versa, and this driving system is called the Simultaneous Address and Display Driving System.

In the above-explained conventional techniques, the so-called progressive scanning drive system is employed, and all the discharge cells in the display region are used for displaying an image during each field period. On the other hand, the so-called interlaced scanning driving system can also be used. In the interlaced scanning driving system, the discharge cells of the plasma panel are divided into two kinds (group A and group B, for example), an image display is performed by alternately using the discharge cells of each of the group A and the group B on successive fields. For example, successive fields are divided into odd-numbered fields and even-numbered fields, and an image display is performed by using the discharge cells of the group A on the odd-numbered fields and using the discharge cells of the group B on the even-numbered fields. Further, in a third driving system, the same scanning electrodes (Y electrodes) may be used both for driving the odd-numbered fields and for driving the even-numbered fields. The plasma display device employing the plasma panel to which the interlaced scanning driving system or the above-described third driving system is applied is called the ALIS (Alternate Lighting of Surfaces) type plasma display device. The details of the ALIS type plasma display device have been reported in Kanazawa, Y., T. Ueda, S. Kuroki, K. Kariya and T. Hirose: "High-Resolution Interlaced Addressing for Plasma Displays," 1999 SID International Symposium Digest of Technical Papers, Volume XXX, 14.1, pp. 154–157 (1999).

SUMMARY OF THE INVENTION

The plasma display device includes a plasma display panel having as its constituent element at least a plurality of discharge cells, creates plasmas in the discharge cells by discharge, and produces an image display by generating visible light by the action of the plasmas. Methods of generating visible light by using the action of the plasmas includes a method of utilizing visible light produced by the plasmas themselves, and a method of utilizing visible light emitted by phosphors excited by ultraviolet rays generated by the plasmas. Usually the latter method is employed for the plasma display devices.

A technical improvement most strongly desired in these plasma display devices is that on luminous efficacy h. The luminous efficacy h is the total luminous flux emitted from the display screen (which is proportional to a product of luminance, a display area and a solid angle) divided by the total electric power input to the display panel for producing the display, and are usually measured in lumens per watt. The higher the luminous efficacy, the brighter display screen can be realized with a small power input to the display panel. Consequently, the higher luminous efficacy is desired in the plasma display devices.

Among the important performance characteristics, of the plasma display devices, there is a contrast C. The contrast C is defined as below.

$$C=Bpon/Boff \tag{2}$$

where

Bpon is a luminance value obtained when a display of the maximum luminance is produced, Boff is a luminance value obtained when a black display is produced, Bpon and Boff are expressed in cd/m$^2$, and luminance is usually measured by using a luminance meter.

The contrast C is classified into light-room contrast Cb and darkroom contrast Cd according to their measuring conditions. The light-room contrast Cb is a contrast as measured in a well-lighted environment (usually assumed to be a living room, that is, an ambient room illumination producing 150–200 lx), and the darkroom contrast Cd is a contrast as measured in a darkroom.

The higher the contrast calculated by using Equation (2), the clearer and more beautiful images can be produced. That is to say, the higher contrast is desired for the plasma display devices.

In the case of the plasma display devices, the luminance Boff is not always zero which is measured when a black display is produced in a darkroom. The reason is that light emission which is not always needed for displaying an image is produced by a preliminary discharge during the preliminary discharge period (also called a reset discharge or an overall-address discharge), or an address discharge during the address discharge period. Consequently, in the case of the plasma display devices, the darkroom contrast is not infinite, but finite, and is expressed by $$Cd=Bpond/Boffd \quad (3)$$

where

Bpond is a luminance (cd/m$^2$) measured when a display of the maximum luminance is produced in a darkroom, and Boffd is a luminance (cd/m$^2$) measured when a black display is produced in the darkroom.

The darkroom contrast Cd is increased by increasing Bpond, or decreasing Boffd, and is determined by the structure of a cell or discharge characteristics.

On the other hand, the light-room contrast Cb is usually increased by using a filter having its transmission characteristics controlled. As described subsequently, when the transmission factor $\alpha$ is decreased so as to increase the light-room contrast Cb, a luminous efficacy in a case when the filter is employed, that is, a set luminous efficacy hs decreases with decreasing $\alpha$. That is to say, in the case of the conventional plasma display devices, a tradeoff must be made between the set luminous efficacy hs and the light-room contrast Cb, and therefore it was difficult to achieve high values of both the high set luminous efficacy hs and the light-room contrast Cb at the same time.

The plasma display device in accordance with the present invention has reduced the restrictions imposed by the tradeoff between its luminous efficacy and its light-room display contrast, and realizes a plasma display device having a high set luminous efficacy (that is, which is capable of providing a high-brightness display image with a low power consumption) and producing a high light-room contrast.

The following explains the summaries of the representative ones of the inventions disclosed in this specification.

(1) A plasma display device comprising a plasma panel and a driving circuit for driving said plasma panel, said plasma panel being provided with a plurality of discharge cells, each of said plurality of discharge cells comprising: at least an X electrode and a Y electrode for producing a display discharge; a dielectric film for covering said X electrode and said Y electrode at least partially; a discharge gas filled in a discharge space; and a phosphor for emitting visible light by being excited by ultraviolet rays produced by discharge of said discharge gas, wherein Vsemax is in a range of from 200 V to 1000 V, where Vsemax is a maximum of an absolute value of a voltage difference between said X electrode and said Y electrode during a display period when display-discharge pulses are applied to said X electrode and said Y electrode for producing said display discharge; wherein in said plasma panel, a display discharge region area ratio Ad satisfies $0.05 \leqq Ad \leqq 0.4$, where, in said plasma panel, a display surface is a surface from which visible light for display is irradiated, a viewing space is a space into which the visible light for display is irradiated from said display surface, a display space is a space containing said plurality of discharge cells arranged continuously, a display region Rp is a projection of said display space onto said display surface, Sp is an area of said display region Rp, a display discharge space is a portion of said discharge space where said display discharge is produced, a display discharge region is a projection of said display discharge space onto said display surface, Rd denotes a collection of said display discharge regions in said display region Rp, Sd is an area of said collection Rd; and Ad=Sd/Sp; and wherein in at least some of said plurality of discharge cells, a ratio of an energy of light emitted from a non-display discharge region to an energy of white light is equal to or smaller than 0.2 when said white light is entered into said non-display discharge region from said viewing space, where a cell region is a projection of one of said plurality of discharge cells onto said display surface, and a non-display discharge region is a portion of said cell region other than said display discharge region.

(2) A plasma display device comprising a plasma panel and a driving circuit for driving said plasma panel, said plasma panel being provided with a plurality of discharge cells, each of said plurality of discharge cells comprising: at least an X electrode and a Y electrode for producing a display discharge; a dielectric film for covering said X electrode and said Y electrode at least partially; a discharge gas filled in a discharge space; and a phosphor for emitting visible light by being excited by ultraviolet rays produced by discharge of said discharge gas, wherein Vsemax is in a range of from 200 V to 1000 V, where Vsemax is a maximum of an absolute value of a voltage difference between said X electrode and said Y electrode during a display period when display-discharge pulses are applied to said X electrode and said Y electrode for producing said display discharge; wherein at least some of said plurality of discharge cells are provided with a black region in which a ratio of an energy of light emitted from a display surface to an energy of white light entered into said display surface is equal to or smaller than 0.2 when said white light is entered into said display surface from a viewing space, where said display surface is a surface from which visible light for display is irradiated, and said viewing space is a space into which the visible light for display is irradiated from said display surface, wherein a black region area ratio Ab satisfies the following inequality: $0.95 \geqq Ab \geqq 0.5$, where a display space is a space containing said plurality of discharge cells arranged continuously, a display region Rp is a projection of said display space onto said display surface, Sp is an area of said display region Rp, Rb denotes a collection of said black regions in said display region Rp, Sb is an area of said black region collection Rb in said display surface, and Ab=Sb/Sp.

(3) A plasma display device comprising a plasma panel and a driving circuit for driving said plasma panel, said plasma panel being provided with a plurality of discharge cells, each of said plurality of discharge cells comprising: at least an X electrode and a Y electrode for producing a display discharge; a dielectric film for covering said X electrode and said Y electrode at least partially; a discharge gas filled in a discharge space; and a phosphor for emitting visible light by being excited by ultraviolet rays produced by discharge of said discharge gas, wherein Vsemax is in a range of from 200 V to 1000 V, where Vsemax is a maximum of an absolute value of a voltage difference between said X electrode and said Y electrode during a display period when display-discharge pulses are applied to said X electrode and said Y electrode for producing said display discharge; wherein at least some of said plurality of discharge cells are provided with a black region of reflectance equal to or lower than 0.5×βmax, where, in said plasma panel, a display surface is a surface from which visible light for display is irradiated, and a viewing space is a space into which the visible light for display is irradiated from said display surface, a reflectance is a ratio of an energy of light emitted from said display surface to an energy of white light entered into said display surface when said white light is entered into said display surface from said viewing space, and β max is a maximum of said reflectance in a respective one of said at least some of said plurality of discharge cells, and wherein a black region area ratio Ab satisfies the following inequality: $0.95 \geqq Ab \geqq 0.5$, where a display space is a space containing said plurality of discharge cells arranged continuously, a display region Rp is a projection of said display space onto said display surface, Sp is an area of said display region Rp, Rb denotes a collection of said black regions in said display region Rp, Sb is an area of said black region collection Rb in said display surface, and Ab=Sb/Sp.

(4) A plasma display device comprising a plasma panel and a driving circuit for driving said plasma panel, said plasma panel being provided with a plurality of discharge cells, each of said plurality of discharge cells comprising: at least an X electrode and a Y electrode for producing a display discharge; a dielectric film for covering said X electrode and said Y electrode at least partially; a discharge gas filled in a discharge space; and a phosphor for emitting visible light by being excited by ultraviolet rays produced by discharge of said discharge gas, wherein Vsemax is in a range of from 200 V to 1000 V, where Vsemax is a maximum of an absolute value of a voltage difference between said X electrode and said Y electrode during a display period when display-discharge pulses are applied to said X electrode and said Y electrode for producing said display discharge; wherein an average reflectance β satisfies $0.02 \leqq \beta \leqq 0.2$, where, in said plasma panel, a display surface is a surface from which visible light for display is irradiated, a viewing space is a space into which the visible light for display is irradiated from said display surface, a display space is a space containing said plurality of discharge cells arranged continuously, a display region Rp is a projection of said display space onto said display surface, a reflectance is a ratio of an energy of light emitted from said display region Rp to an energy of white light entered into said display region Rp when said white light is entered into said display region Rp from said viewing space, and an average reflectance β is said reflectance averaged over said display region.

(5) A plasma display device according to (1), wherein said driving circuit comprises a dc power supply for outputting a plurality of voltages including ground potential for forming said display-discharge pulses, and a switch circuit coupled between said dc power supply and said X and Y electrodes, and Vsdc is in a range of from 200 V to 1000 V, where Vsdc is defined as an absolute value of a voltage difference between maximum and minimum voltages of said plurality of voltages outputted during said display period.

(6) A plasma display device according to (2), wherein said driving circuit comprises a dc power supply for outputting a plurality of voltages including ground potential for forming said display-discharge pulses, and a switch circuit coupled between said dc power supply and said X and Y electrodes, and Vsdc is in a range of from 200 V to 1000 V, where Vsdc is defined as an absolute value of a voltage difference between maximum and minimum voltages of said plurality of voltages outputted during said display period.

(7) A plasma display device according to (3), wherein said driving circuit comprises a dc power supply for outputting a plurality of voltages including ground potential for forming said display-discharge pulses, and a switch circuit coupled between said dc power supply and said X and Y electrodes, and Vsdc is in a range of from 200 V to 1000 V, where Vsdc is defined as an absolute value of a voltage difference between maximum and minimum voltages of said plurality of voltages outputted during said display period.

(8) A plasma display device according to (4), wherein said driving circuit comprises a dc power supply for outputting a plurality of voltages including ground potential for forming said display-discharge pulses, and a switch circuit coupled between said dc power supply and said X and Y electrodes, and Vsdc is in a range of from 200 V to 1000 V, where Vsdc is defined as an absolute value of a voltage difference between maximum and minimum voltages of said plurality of voltages outputted during said display period.

(9) A plasma display device according to (1), wherein said discharge gas contains a Xe gas of a proportion aXe equal to or greater than 0.1, where ng is a volume particle (atom or molecule) density of said discharge gas, nXe is a volume particle density of said Xe gas, and aXe=nXe/ng.

(10) A plasma display device according to (2), wherein said discharge gas contains a Xe gas of a proportion aXe equal to or greater than 0.1, where ng is a volume particle (atom or molecule) density of said discharge gas, nXe is a volume particle density of said Xe gas, and aXe=nXe/ng.

(11) A plasma display device according to (3), wherein said discharge gas contains a Xe gas of a proportion axe equal to or greater than 0.1, where ng is a volume particle (atom or molecule) density of said discharge gas, nXe is a volume particle density of said Xe gas, and axe=nXe/ng.

(12) A plasma display device according to (4), wherein said discharge gas contains a Xe gas of a proportion axe equal to or greater than 0.1, where ng is a volume particle (atom or molecule) density of said discharge gas, nXe is a volume particle density of said Xe gas, and aXe=nXe/ng.

(13) A plasma display device according to (1), further comprising a plurality of barrier ribs, wherein said plurality of barrier ribs extend in approximately one direction, are arranged in a direction perpendicular to said one direction, and form part of said plurality of discharge cells, and in at least some of said discharge cells, an average width of said plurality of barrier ribs averaged over a height thereof is 0.1 mm or more.

(14) A plasma display device according to (2), further comprising a plurality of barrier ribs, wherein said plurality of barrier ribs extend in approximately one direction, are arranged in a direction perpendicular to said one direction, and form part of said plurality of discharge cells, and in at least some of said discharge cells, an average width of said plurality of barrier ribs averaged over a height thereof is 0.1 mm or more.

(15) A plasma display device according to (3), further comprising a plurality of barrier ribs, wherein said plurality of barrier ribs extend in approximately one direction, are arranged in a direction perpendicular to said one direction, and form part of said plurality of discharge cells, and in at least some of said discharge cells, an average width of said plurality of barrier ribs averaged over a height thereof is 0.1 mm or more.

(16) A plasma display device according to (4), further comprising a plurality of barrier ribs, wherein said plurality of barrier ribs extend in approximately one direction, are arranged in a direction perpendicular to said one direction, and form part of said plurality of discharge cells, and in at least some of said discharge cells, an average width of said plurality of barrier ribs averaged over a height thereof is 0.1 mm or more.

(17) A plasma display device according to (1), further comprising a plurality of barrier ribs, wherein said plurality of barrier ribs extend in two directions intersecting each other in a grid pattern, and form part of said plurality of discharge cells, and in at least some of said discharge cells, an average width of said plurality of barrier ribs averaged over a height thereof is 0.1 mm or more in said plurality of barrier ribs extending in at least one of said two directions.

(18) A plasma display device according to (2), further comprising a plurality of barrier ribs, wherein said plurality of barrier ribs extend in two directions intersecting each other in a grid pattern, and form part of said plurality of discharge cells, and in at least some of said discharge cells, an average width of said plurality of barrier ribs averaged over a height thereof is 0.1 mm or more in said plurality of barrier ribs extending in at least one of said two directions.

(19) A plasma display device according to (3), further comprising a plurality of barrier ribs, wherein said plurality of barrier ribs extend in two directions intersecting each other in a grid pattern, and form part of said plurality of discharge cells, and in at least some of said discharge cells, an average width of said plurality of barrier ribs averaged over a height thereof is 0.1 mm or more in said plurality of barrier ribs extending in at least one of said two directions.

(20) A plasma display device according to (4), further comprising a plurality of barrier ribs, wherein said plurality of barrier ribs extend in two directions intersecting each other in a grid pattern, and form part of said plurality of discharge cells, and in at least some of said discharge cells, an average width of said plurality of barrier ribs averaged over a height thereof is 0.1 mm or more in said plurality of barrier ribs extending in at least one of said two directions.

(21) A plasma display device according to (17), wherein an absolute value $|zY-zX|$ is 0.2 mm or more, when a z axis is drawn in a direction of a height of said plurality of barrier ribs, zX is a z-axis coordinate of said X electrode, zY is a z-axis coordinate of said Y electrode.

(22) A plasma display device according to (18), wherein an absolute value $|zY-zX|$ is 0.2 mm or more, when a z axis is drawn in a direction of a height of said plurality of barrier ribs, zX is a z-axis coordinate of said X electrode, zY is a z-axis coordinate of said Y electrode.

(23) A plasma display device according to (19), wherein an absolute value $|zY-zX|$ is 0.2 mm or more, when a z axis is drawn in a direction of a height of said plurality of barrier ribs, zX is a z-axis coordinate of said X electrode, zY is a z-axis coordinate of said Y electrode.

(24) A plasma display device according to (20), wherein an absolute value $|zY-zX|$ is 0.2 mm or more, when a z axis is drawn in a direction of a height of said plurality of barrier ribs, zX is a z-axis coordinate of said X electrode, zY is a z-axis coordinate of said Y electrode.

(25) A plasma display device according to (21), wherein a non-aperture-surface surface reflectance is 80% or more, where a solid wall surrounding said display discharge space is called an inner surface of said display discharge space, a portion of said inner surface of said display discharge space from which the visible light for a display is emitted into said viewing space is called an aperture surface, a portion of said inner surface of said display discharge space other than said aperture surface is called a non-aperture-surface, said non-aperture-surface surface reflectance is defined as a surface reflectance of said non-aperture-surface averaged over said non-aperture-surface.

(26) A plasma display device according to (22), wherein a non-aperture-surface surface reflectance is 80% or more, where a solid wall surrounding said display discharge space is called an inner surface of said display discharge space, a portion of said inner surface of said display discharge space from which the visible light for a display is emitted into said viewing space is called an aperture surface, a portion of said inner surface of said display discharge space other than said aperture surface is called a non-aperture-surface, said non-aperture-surface surface reflectance is defined as a surface reflectance of said non-aperture-surface averaged over said non-aperture-surface.

(27) A plasma display device according to (23), wherein a non-aperture-surface surface reflectance is 80% or more, where a solid wall surrounding said display discharge space is called an inner surface of said display discharge space, a portion of said inner surface of said display discharge space from which the visible light for a display is emitted into said viewing space is called an aperture surface, a portion of said inner surface of said display discharge space other than said aperture surface is called a non-aperture-surface, said non-aperture-surface surface reflectance is defined as a surface reflectance of said non-aperture-surface averaged over said non-aperture-surface.

(28) A plasma display device according to (24), wherein a non-aperture-surface surface reflectance is 80% or more, where a solid wall surrounding said display discharge space is called an inner surface of said display discharge space, a portion of said inner surface of said display discharge space from which the visible light for a display is emitted into said viewing space is called an aperture surface, a portion of said inner surface of said display discharge space other than said aperture surface is called a non-aperture-surface, said non-aperture-surface surface reflectance is defined as a surface reflectance of said non-aperture-surface averaged over said non-aperture-surface.

(29) An image display system employing a plasma display device according to (1).

(30) An image display system employing a plasma display device according to (2).

(31) An image display system employing a plasma display device according to (3).

(32) An image display system employing a plasma display device according to (4).

DETAILED DESCRIPTION OF THE PREFERRED EMBODIMENTS

Before explaining the embodiments in accordance with the present invention, the results of various studies by the present inventors will be explained.

Figure 8:
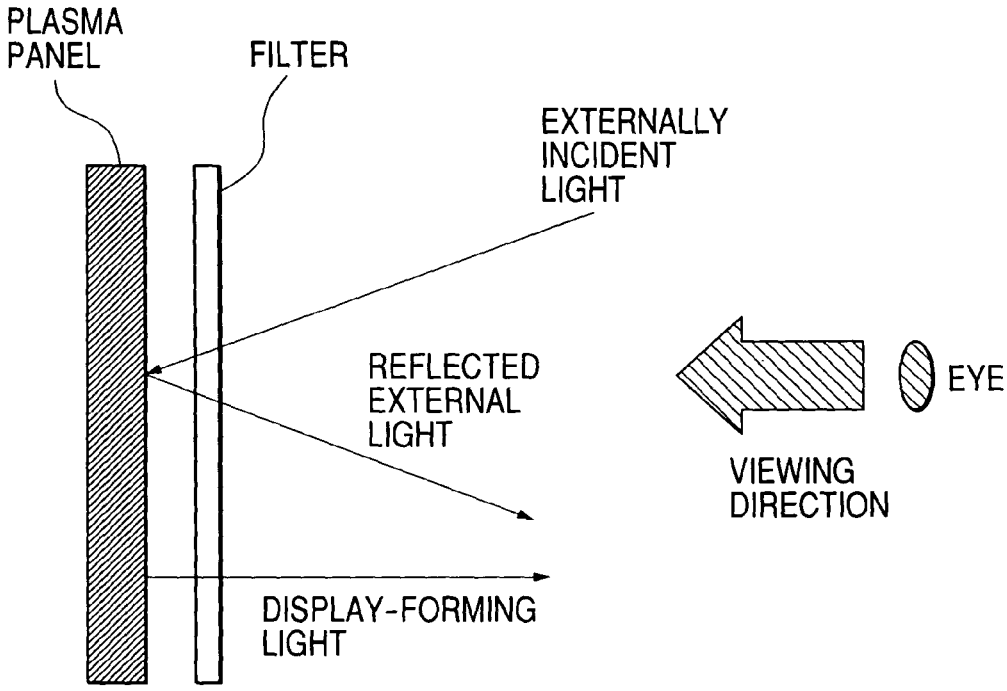
FIG. 8 is an illustration of a configuration of a combination of a plasma panel and a filter.

Usually a filter having its light transmission characteristics controlled is used to increase the above-described light-room contrast Cb. FIG. 8 is a schematic illustration of an outline of its configuration. The following explains a principle of increasing the light-room contrast Cb by using a filter.

In the configuration of FIG. 8, a portion designated "plasma panel" usually corresponds to a basic plasma panel, which is sometimes called a module.

In the configuration of FIG. 8, when a display image is viewed in the viewing direction indicated in FIG. 8, the light-room contrast Cb is roughly expressed by $$Cb=(Bponm\times\alpha+Br\times\alpha^2\times\beta)/(Boffm\times\alpha+Br\times\alpha^2\times\beta) \quad (4)$$

where

Bponm (cd/m$^2$) is a luminance value obtained when a display of the maximum luminance is produced without a filter (that is, only by a plasma panel) in a darkroom, this is, a module luminance or a module peak luminance;

Boffm (cd/m$^2$) is a luminance value obtained when a black display is produced without a filter, that is, only by a plasma panel, in the darkroom;

Br (cd/m$^2$) is a luminance produced at an imaginary completely reflecting surface (a diffusing reflecting surface of 100% in surface reflectance) on a front surface (a viewer-side surface) of a filter, by external light in a light-room;

$\alpha$ is a transmission factor of the filter; and $\beta$ is a surface reflectance averaged over a surface in a display region of the plasma panel, that is, a display region surface reflectance.

When L (lx) is an ambient illuminance in the light-room, $Br=L/\pi\approx L/3.14$ cd/m$^2$.

In a system where part of light incident on a surface (an incident surface) of an object leaves the surface as the reflected light, the surface reflectance is the ratio of the reflected light energy to the incident light energy, and in a system where part of light incident on a surface (an incident surface) of an object is transmitted through the object as the transmitted light, the transmission factor is the ratio of the transmitted light energy to the incident light energy.

In principle, both the surface reflectance and the transmission factor can be defined and measured at arbitrary locations positioned with accuracy of the order of wavelengths of the incident light. Usually, both the surface reflectance and the transmission factor are measured as a function of positions on the incident surface by using a surface reflectometer and a transmissometer, respectively.

Usually, both the surface reflectance and the transmission factor are functions of wavelengths of incident light. Therefore, the surface reflectance $\beta$ and the transmission factor $\alpha$ are average values determined by considering the spectrum in the range of ambient visible light in the home room and the standard luminosity curve of the human eye. For the sake of convenience, the surface reflectance $\beta$ and the transmission factor $\alpha$ may be values averaged over the wavelength range of from 500 nm to 600 nm to which the human eye has a strong brightness sensation.

In Equation (4), it is assumed that there is no reflection of visible light on the surface of the filter.

When zero is substituted for Br in Equation (4), Cb gives the darkroom contrast Cd.

$$Cd=Bponm/Boffm \quad (5)$$

In Equation (4), under the usual light-room condition (the light-room ambient illuminance L=150–200 lx), $$Bponm\times\alpha>>Br\times\alpha^2\times\beta$$

$$Boffm\times\alpha<<Br\times\alpha^2\times\beta.$$

Therefore Equation (4) gives $$Cb\approx Bponm/(Br\times\alpha\times\beta) \quad (6)$$

That is to say, the light-room contrast Cb increases in inverse proportion to the transmission factor $\alpha$ of the filter when the factor $\alpha$ is decreased with Bponm, Br and $\beta$ being fixed. This is the principle on which the light-room contrast is increased by using the filter.

In the following the luminous efficacy will be discussed. The luminous efficacy h is divided into two kinds: the luminous efficacy hm for a case where no filter is employed (that is, the plasma panel only in FIG. 8) and the luminous efficacy hs for a case where a filter is employed (that is, the filter is employed as in FIG. 8).

$$hm=\alpha\times Bponm\times Sp/Pp \quad (7)$$

$$hs=\pi\times Bponm\times\alpha\times Sp/Pp \quad (8a)$$

$$=\alpha\times hm \quad (8b)$$

where hm is a luminous efficacy (lm/W) measured when no filter is employed, and is called a module luminous efficacy;

hs is a luminous efficacy (lm/W) measured when a filter is employed, and is called a set luminous efficacy;

π is the ratio of the circumference of a circle to its diameter;

Sp is an area ($m^2$) of a light-emission display region;

Pp is an electric power (W) input to the plasma panel; and light emission is assumed to be perfectly diffusing light emission.

Equations (7), (8a) and (8b) represent the cases when a display of the maximum luminance is produced, and the relationship of Equation (8b) holds for a display exhibiting arbitrary gray scale levels.

Among the above two kinds of the luminous efficacies, the ultimately important one is necessarily the set luminous efficacy. Equation (8b) shows that, even when the module luminous efficacy hm is kept constant, if the filter transmission α is decreased so as to increase the light-room contrast Cb, then the set luminous efficacy hs decreases in proportion to the filter transmission factor α.

That is to say, in the case of the conventional plasma display devices, there is a tradeoff between the set luminous efficacy hs and the light-room contrast Cb, and therefore it was difficult to achieve high values of both the high set luminous efficacy hs and the light-room contrast Cb at the same time.

An object of the present invention is to realize a plasma display device having a high set luminous efficacy (that is, which is capable of providing a high-brightness display image with a low power consumption) and producing a high light-room contrast.

In the following, initially techniques will be discussed which increase the luminous efficacy of the plasma display devices, and then techniques will be discussed which increase the light-room contrast also without decreasing the filter transmission factor α.

It is most important for increasing the luminous efficacy of the plasma display devices to increase the ultraviolet production efficiency hvuv by discharge. This is reported in the present inventors' published papers, Suzuki, K., N. Uemura, S. Ho, and M. Shiiki: "Ultraviolet Ray Production Efficiency of AC-PDPs," Monthly Magazine Display, Vol. 7, No. 5, pp. 48–53 (May, 2001), and Suzuki, K., N. Uemura, S. Ho, and M. Shiiki: "Ultraviolet Production Efficiency of AC-PDPs and Ways to Increase It," 3rd International Conference on Atomic and Molecular Data and Their Applications ICAMDATA, AIP Conference Proceedings, Vol. 636, pp. 75–84 (2002). The ultraviolet ray production efficiency hvuv is the ratio of the amount in terms of wattage of ultraviolet rays generated by discharge to an electric power input to a plasma panel.

The theoretical studies by the present inventors and others have made it clear that there are basically two ways for increasing the ultraviolet ray production efficiency: (1) lowering of the electron temperature Te of discharge, and (2) increasing of a Xe proportion aXe in the discharge gas. The studies were reported in the present inventors' published papers, Suzuki, K., Y. Kawanami, S. Ho, N. Uemura, Y. Yajima, N. Kouchi and Y. Hatano: "Theoretical formulation of the VUV production efficiency in a plasma display panel," J. Appl. Phys., Vol. 88, pp. 5605–5611 (2000). In the above studies, the ultraviolet ray generating atoms in the discharge were assumed to be Xe atoms, as in a (Ne+Xe) gas mixture composed of Ne and Xe, and another gas mixture composed of Ne, Xe and another gas of other atoms or molecules.

The Xe proportion aXe in a discharge gas is defined as the ratio nXe/ng, where ng is a volume particle (atom or molecule) density of the discharge gas, and nXe is a volume particle density of a Xe gas contained in the discharge gas. The volume particle densities ng and nXe are measured by analyzing constituent atoms or molecules of the discharge gas using a mass spectrograph, for example. Conventionally, the Xe proportion aXe was usually 4% to 6%.

Figure 2:
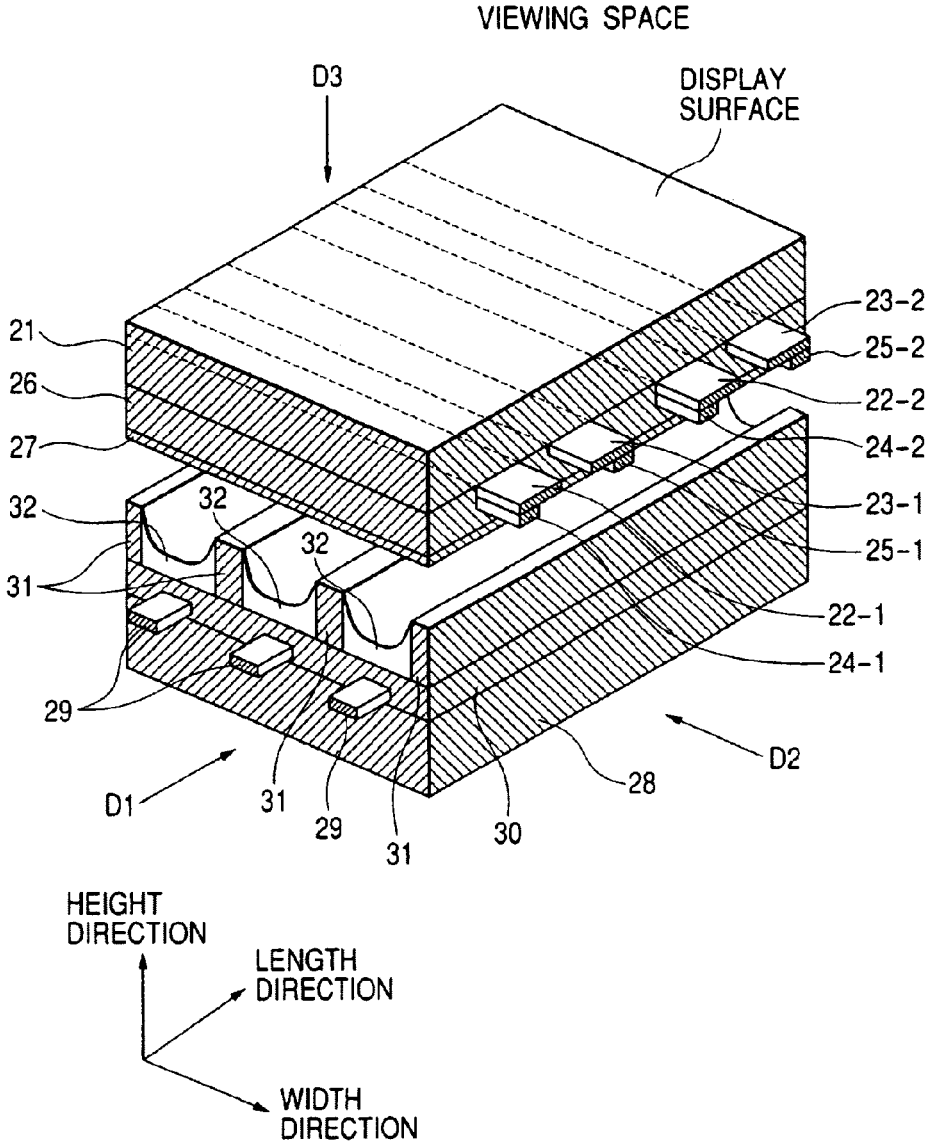
FIG. 2 PRIOR ART
FIG. 2 is an exploded perspective view illustrating a part of a structure of an embodiment of a plasma display device in accordance with the present invention.

Further studies by the present inventors have made it clear that the most effective method for the lowering of the electron temperature Te of discharge in the above-mentioned (1) is (1a) increasing of the pd product in the discharge. The pd product is the product of the pressure p of the discharge gas and a distance d between the discharge electrodes. The pressure p of the discharge gas can be measured by a pressure gauge, for example. The distance d between the discharge electrodes is a distance between the X and Y electrodes which serve as display electrodes in the conventional plasma display shown in FIG. 2, for example. In a case where the electrodes are indented in a direction across the spacing between the two electrodes, the distance d is a distance between portions of the two electrodes where an effective discharge occurs.

Figure 9A:
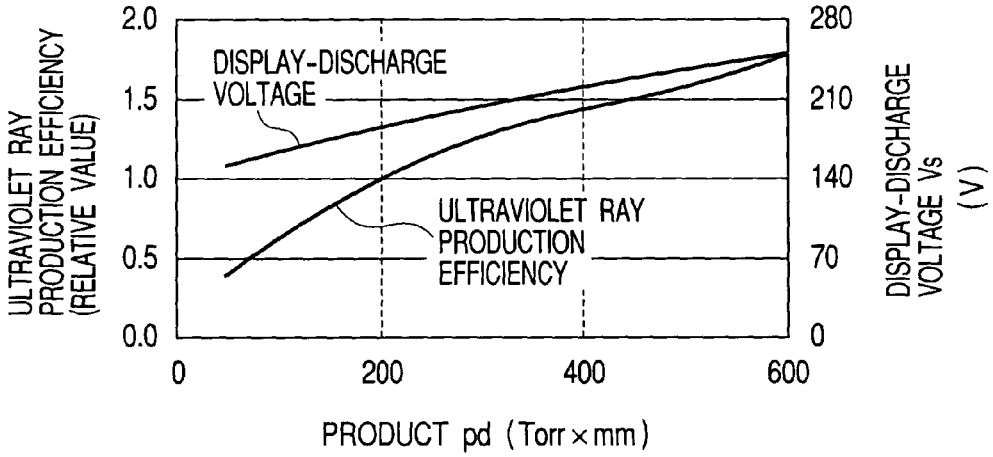
FIGS. 9A and 9B are graphs for explaining a method of increasing an efficiency of producing ultraviolet rays.
Figure 9B:
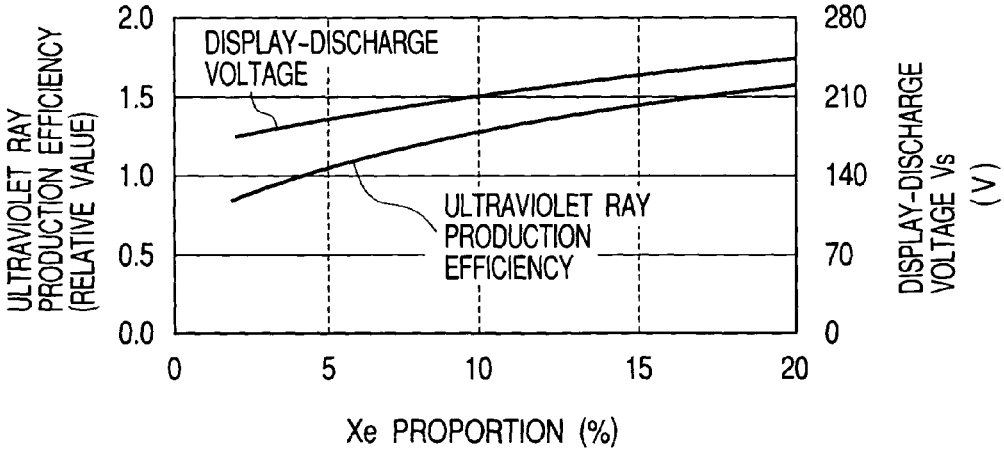

The results of the studies by the present inventors are summarized as follows:

A1: The most effective method for increasing the luminous efficacy (ultraviolet ray production efficiency) of the plasma display device are basically divided into the two kinds: (1a) increasing of the product pd in discharge; and (2) increasing of the Xe proportion aXe of the discharge gas. FIGS. 9A and 9B show the effects of the above two in terms of relative values of ultraviolet ray production efficiencies.

The important facts to be noted here are as follows:

A2: The display discharge voltage Vs is increased by both the two methods of increasing the luminous efficacy h, which are (1a) increasing of the product pd in discharge, and (2) increasing of the Xe proportion aXe of the discharge gas. FIGS. 9A and 9B show this effect. FIG. 9A shows the ultraviolet ray production efficiencies and display discharge voltages Vs when the product pd is varied at the Xe proportion aXe=4%, and FIG. 9B shows the ultraviolet ray production efficiencies and display discharge voltages Vs when the Xe proportion aXe is varied for the product pd=200 Torr×mm.

Here, the display discharge voltage Vs is an effective voltage to be applied between the display electrodes for sustaining a display discharge, and more specifically, it is approximately the maximum applied display discharge voltage Vsemax or is a display-discharge dc power supply voltage Vsdc. Conventionally, the display discharge voltage Vs was in a range of from 150 V to 180 V.

As shown in FIGS. 9A and 9B, the display discharge voltage Vs needs to be equal to or higher than 200 V for making the ultraviolet ray production efficiency sufficiently higher. Further, to heighten the above effects, the display discharge voltage Vs needs to be selected to be equal to or higher than 220 V. Further, for example, to realize the effects of both the high pd product and the high Xe proportion at the same time, the display discharge voltage Vs needs to be 220 V or higher, and preferably, to be 260 V or more.

The following will discuss the discharge electric power Pp input to the plasma panel.

The discharge electric power Pp input to the plasma panel is expressed by the following equations.

$$Pp=Nc\times Pc \tag{9}$$

$$Pc=2\times Fdr\times Cse\times Vs^2 \tag{10}$$

where

Pp=a discharge electric power (W) input to a plasma panel,

Pc=a discharge electric power (W) input to one discharge cell,

Nc=the number of the discharge cells in the plasma panel (a display space),

Fdr=a drive frequency (Hz),

Cse=a display-electrode capacitance (F) formed within one discharge cell, and

Vs=a display discharge voltage (V).

The drive frequency Fdr is the number of times when a voltage is applied to the display electrode periodically per unit time (one second). The display-electrode capacitance Cse is a capacitance formed by the display electrode (the X or Y electrode) with a virtual electrode on a surface of the protective film 27 via the dielectric 26 and the protective film 27 within one discharge cell. The display-electrode capacitance Cse is expressed by $$Cse=\epsilon\times Sse/Dsif \tag{11}$$

where

∈=an average dielectric constant ($CV^{-1}m^{-1}$) of a combination of the dielectric 26 and the protective film 27, Sse=a display-electrode area ($m^2$), an area of the display electrode (the X or Y electrode) within one discharge cell, and Dsif=the sum (m) of thicknesses of the dielectric 26 and the protective film 27.

From Equations (9), (10) and (11), the discharge electric power Pp input to the plasma panel is expressed by $$Pp=2\times Nc\times\in\times Fdr\times(Sse/Dsif)\times Vs^2 \tag{12}$$

Other conditions being fixed, it follows that when the same discharge electric power Pp input to the plasma panel is to be realized, the display-electrode area Sse decreases in inverse proportion to the square of the display discharge voltage Vs. That is to say, when the display discharge voltage Vs is increased, even if the display-electrode area Sse is reduced in inverse proportion to the display discharge voltage Vs, the same amount of the discharge electric power Pp can be input to the plasma panel.

Further from Equation (8a), $$Bpons=hs\times Pp/(\pi\times Sp) \tag{13}$$

$$Bpons=Bponsm\times\alpha \tag{14}$$

where Bpons is a luminance ($cd/m^2$) measured when a filter is employed and a display of the maximum luminance is produced in a darkroom, that is, a set luminance or a set peak luminance.

Consequently, in the above-described methods, even when the display-electrode area Sse is reduced, if the discharge electric power Pp input to the plasma panel can be kept fixed, then the light emission luminance of the plasma display device can also be kept fixed.

It is usually thought that even if the luminous efficacy is increased, the employed method is not desirable because the display discharge voltage Vs is increased and thereby the cost of the circuit is increased. However, the various studies by the present inventors have made clear the following pronounced advantages as described above.

A3: When the display discharge voltage Vs is increased with at least the luminous efficacy hs being kept fixed, even if the display-electrode area Sse is reduced in inverse proportion to $Vs^2$, the fixed amount of the discharge electric power Pp input to the plasma panel and the fixed light emission luminance can be ensured.

By further investigations based upon their own findings A1, A2 and A3 described above, the present inventors have invented a technique of realizing a plasma display device providing a high set luminous efficacy (i.e. producing a high-brightness display image at a low power consumption) and producing a high light-room contrast. In the following, its basic concept will be explained.

In the first place, the difficulties in developing the techniques are represented by Equations (6), (8b) and (14). As described above, even when the module luminous efficacy hm and the module luminance are kept fixed, if the filter transmission factor α is reduced so as to increase the light-room contrast Cb (see Equation (6)), the set luminous efficacy hs and the set luminance Bpons are decreased in proportion to α (see Equations (8b) and (14)).

However, by further investigations into Equations (6), (8b) and (14), the following is found.

A4: If the surface reflectance β of the display region of the plasma panel can be made smaller, the light-room contrast Cb can be increased without reducing the set luminous efficacy hs or the set luminance Bpons.

The surface reflectance β of the display region is an average surface reflectance averaged over the display region. The primary factor in increasing the surface reflectance β of the display region is the ratio (i.e. a discharge region area ratio) of an area (i.e. a discharge region area) of the display surface occupied by the discharge region to an area (i.e. a display region area) of the display surface occupied by the display region. Especially important is the ratio (i.e. a display discharge region area ratio) of a display discharge region area (an area of the display surface occupied by the display discharge region) to the display region area. The reason is that discharge spaces (especially display discharge spaces) forming discharge regions are spaces where display discharges are produced, and are provided with phosphors extending over wide areas for converting ultraviolet rays generated by display discharge into visible light.

Usually the phosphor layers have high reflectance so as to use the visible light produced by the phosphors effectively. That is to say, the phosphor layers appear white when viewed from the outside. Further, the structure itself of the discharge spaces is configured so as to emit the visible light produced by the phosphor layers efficiently into the viewing space. That is to say, the discharge spaces appear white when viewed from the outside, and therefore the reflectance of the discharge regions are high. Consequently, the surface reflectance β of the display region is increased when the discharge region area ratio (especially the display discharge region area ratio) is increased. The display discharge region area ratio Ad is expressed by $$Ad=Sd/Sp \tag{15}$$

where Sd=a display discharge region area ($m^2$), and

Sp=a display region area ($m^2$).

Conventionally, the display discharge region area ratio Ad is 45% or more, and therefore, conventionally the surface reflectance β of the display region is 25% or more.

The display discharge region area ratio Ad and the surface reflectance β of the display region are determined by the display discharge region area Sd and the display-electrode area Sse within each of the discharge cells. That is to say, A5: If the display-electrode area Sse is reduced, then the display discharge region area Sd is reduced, and as a result the surface reflectance β of the display region is made smaller.

The following fact A6 is understood only after putting together and understanding all the above facts A1 to A5 made clear successively in connection with the present invention.

A6: The luminous efficacy hs and the display discharge voltage Vs are increased by (1a) increasing the product pd in discharge or (2) increasing the Xe proportion aXe of the discharge gas, thereby the display discharge region area ratio Ad and the surface reflectance β of the display region of the plasma panel can be made smaller by reducing the display-electrode area Sse approximately in inverse proportion to $Vs^2$. Consequently, this makes it possible to increase the set luminous efficacy hs, the set luminance Bpons and the light-room contrast Cb. This is the basic principle of the present invention.

As shown in FIGS. 9A and 9B, when the luminous efficacy hs is increased by (1a) increasing the product pd in discharge or (2) increasing the Xe proportion aXe of the discharge gas, the display discharge voltage Vs increases to 200V or more, 220 V or more, 240V or more, or 260V or more, depending upon the desired luminous efficacy hs, while conventionally the display discharge voltage Vs was in a range of from 150V to 180V. On the other hand, due to the limitations imposed by the withstand voltages of device structures and their materials, the allowable display discharge voltage Vs is equal to or lower than 1000V. Consequently, the display discharge region area ratio Ad can be reduced to 40% or less, 35% or less, 30% or less, or 20% or less according to desired individual specifications, while the conventional display discharge region area ratio is 45% or more (65% or more in the case of the ALIS type plasma display devices), and further, the surface reflectance β of the display region can be reduced to 20% or less, 17% or less, 15% or less, or 10% or less according to desired individual specifications, while the conventional surface reflectance of the display region is 25% or more.

In the following, the embodiments in accordance with the present invention will be explained in detail by reference to the drawings. Throughout the figures for explaining the embodiments, the same reference numerals or symbols are used to designate functionally similar parts or portions in the above-explained prior art, and repetition of their explanation is omitted.

Embodiment 1

Figure 1:
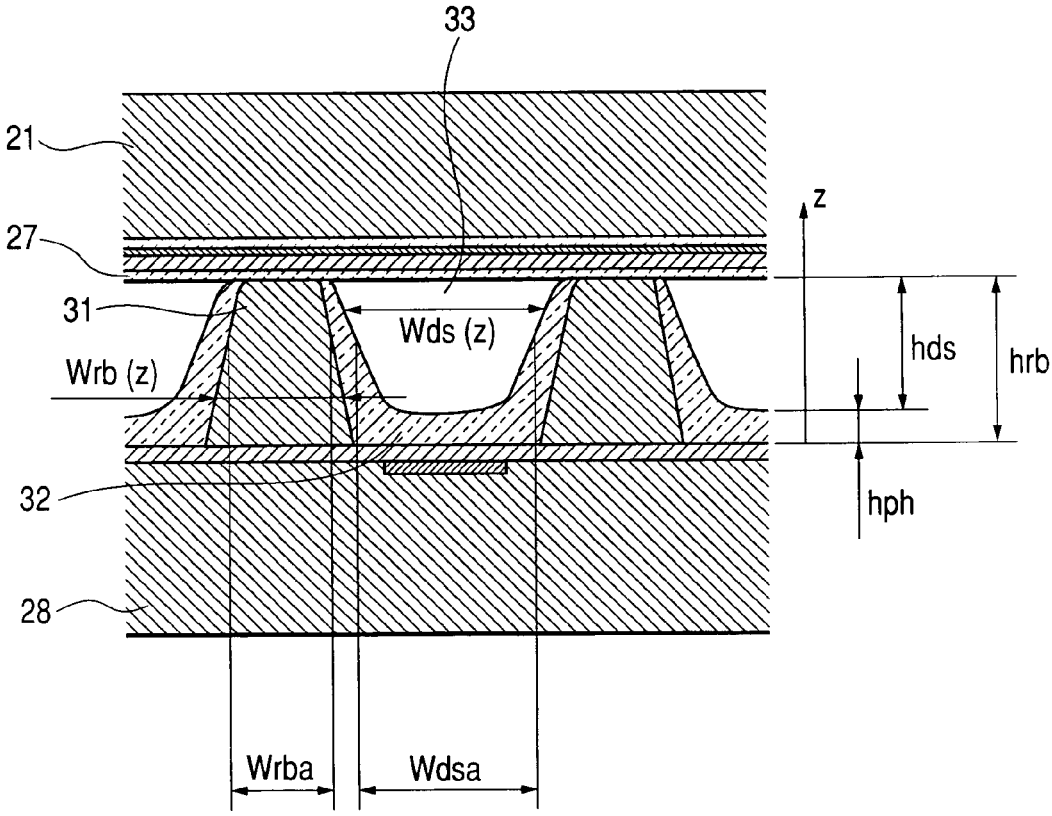
FIG. 1 is a cross-sectional view of Embodiment 1 of a plasma display device in accordance with the present invention.
Figure 3:
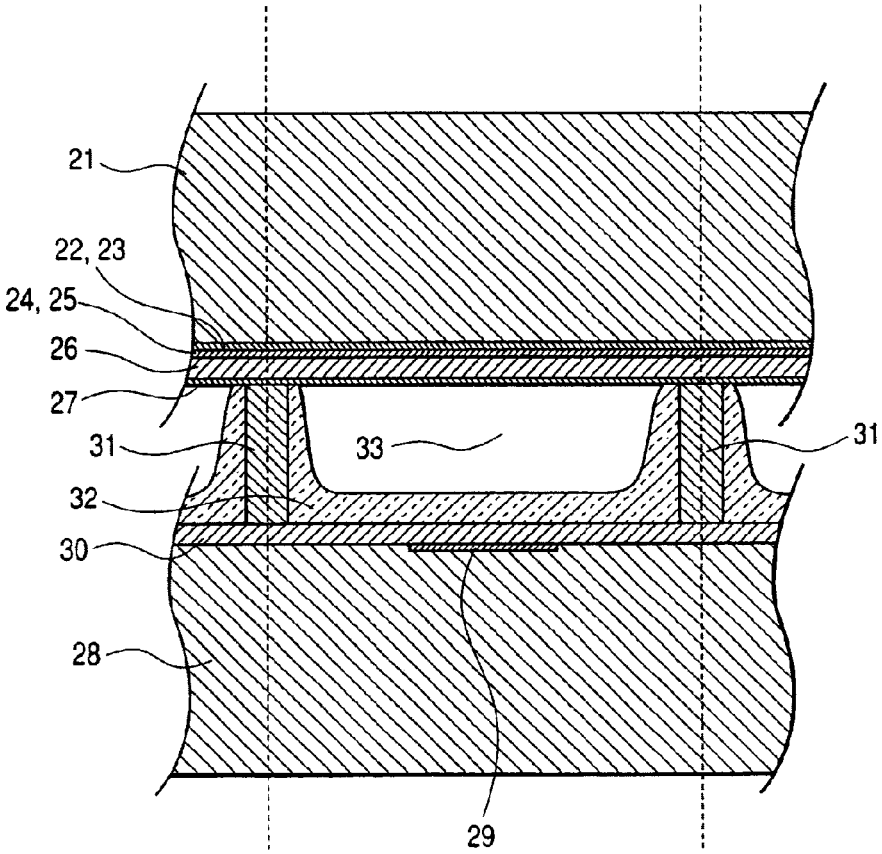
FIG. 3 PRIOR ART
FIG. 3 is a cross-sectional view of the plasma display device of FIG. 2 viewed in the direction of the arrow D1 of FIG. 2.
Figure 4:
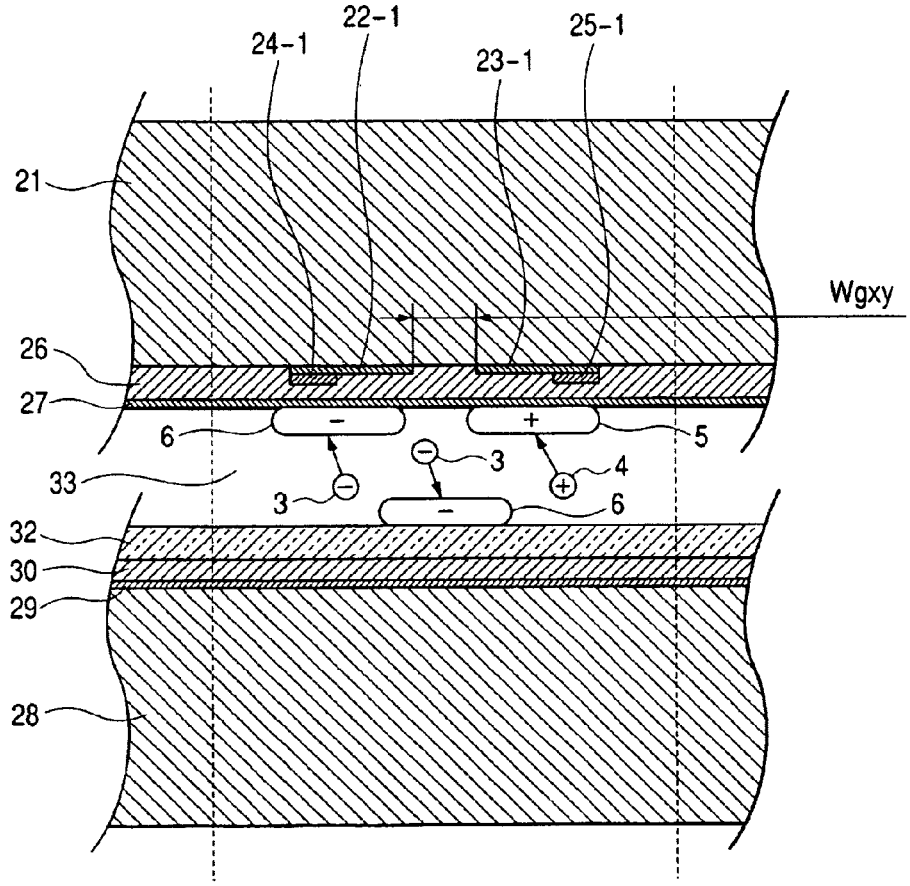
FIG. 4 PRIOR ART
FIG. 4 is a cross-sectional view of the plasma display device of FIG. 2 viewed in the direction of the arrow D2 of FIG. 2.
Figure 5:
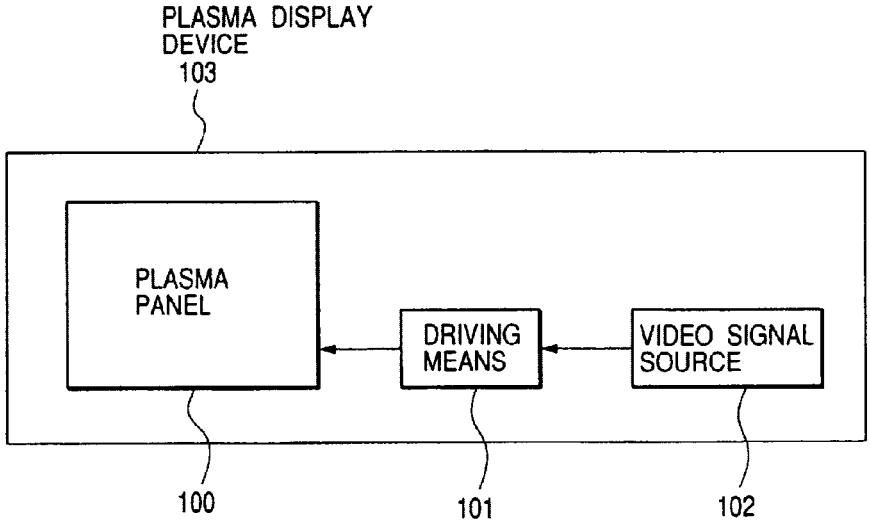
FIG. 5 PRIOR ART
FIG. 5 is a block diagram illustrating an image display system employing a PDP.
Figure 6A:
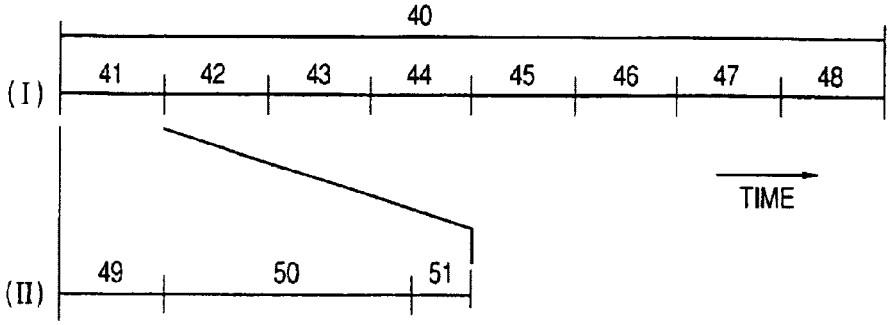
FIG. 6A PRIOR ART
FIGS. 6A–6C illustrate an operation during one TV field required for displaying one picture on the PDP.
Figure 6B:
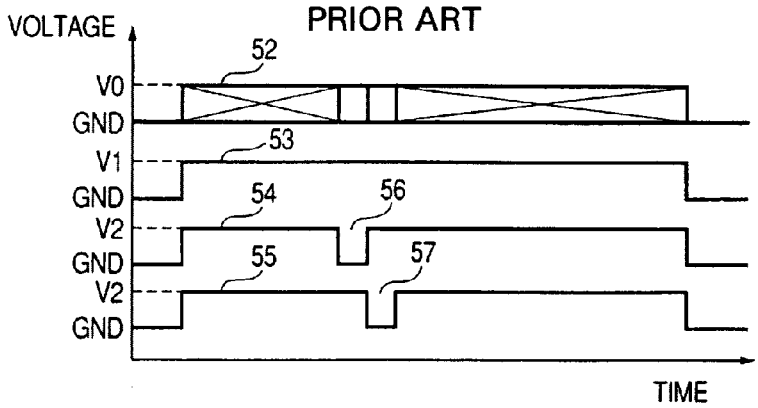
FIG. 6B PRIOR ART
Figure 6C:
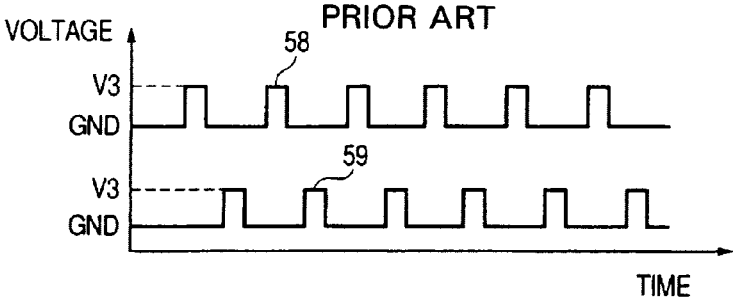
FIG. 6C PRIOR ART
Figure 7:
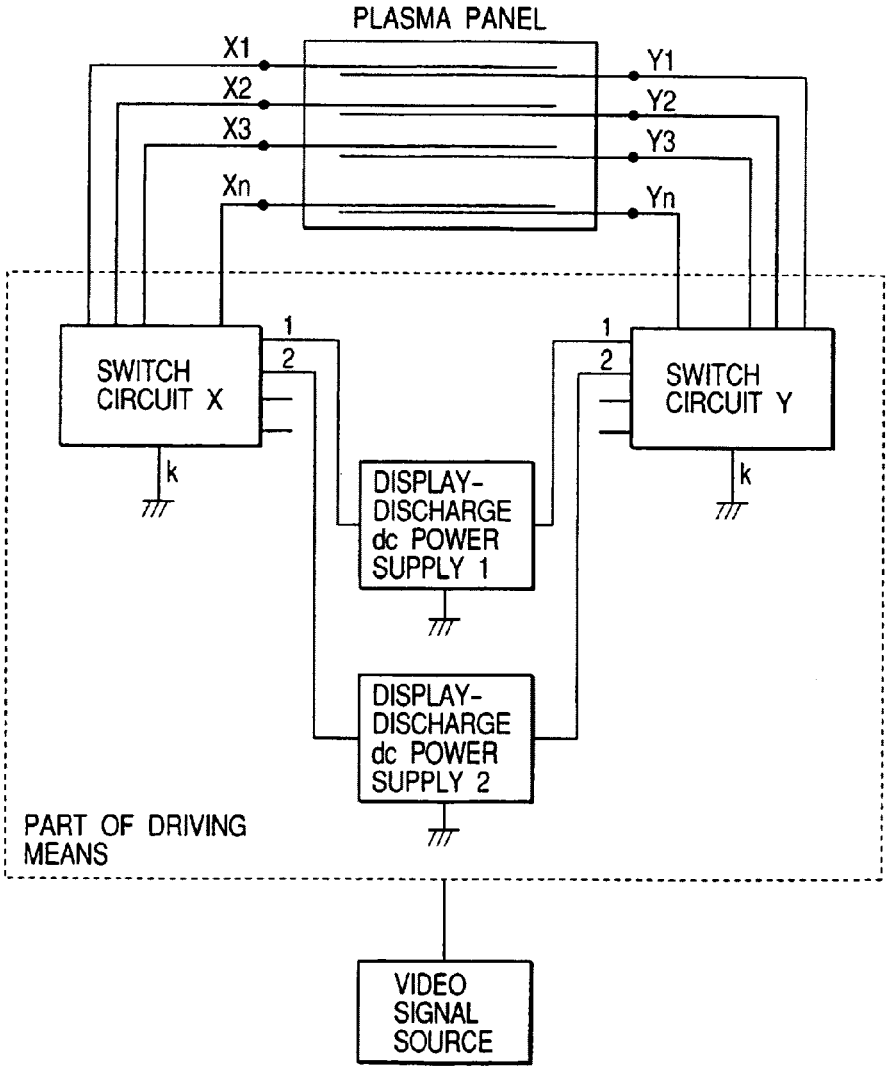
FIG. 7 PRIOR ART
FIG. 7 is a block diagram for illustrating a part of a driving means for the PDP.

FIG. 1 is a cross-sectional view of a basic plasma panel in Embodiment 1 in accordance with the present invention, and is similar to that of FIG. 3 illustrating the prior art. The discharge space 33 is surrounded by the protective film 27 and the phosphor 32. In FIG. 1, a width direction of the barrier rib 31 is in a lateral direction, a height direction of the barrier rib 31 is in a direction perpendicular to the width direction, that is, in a vertical direction in FIG. 1, and the z axis is drawn in the height direction. A direction perpendicular to both the width direction and the height direction, that is, a direction perpendicular to the plane of the paper, is a length direction of the barrier rib 31.

Wds(z) and Wrb(z) are a discharge space width and a barrier rib width, respectively, as measured in the width direction. The discharge space width Wds(z) and the barrier rib width Wrb(z) are functions of heights, that is, z coordinates. hds and hrb are a discharge space height and a barrier rib height, respectively, as measured in the height direction. An average discharge space width Wdsa is the discharge space width Wds(z) averaged over the discharge space height hds, an average barrier rib width Wrba is the barrier rib width Wrb(z) averaged over the barrier rib height hrb, and hph is a thickness of the phosphor layer. In the prior art, the average barrier rib width Wrba is selected to be as narrow as possible, and usually is 0.06 mm or less.

The following explains differences between Embodiment 1 shown in FIG. 1 and the prior art explained in connection with FIGS. 2–6, and the reasons for the differences. Among the reasons for the differences and the advantages provided by Embodiment 1, the already explained ones will be omitted.

To increase the ultraviolet ray production efficiency, the Xe proportion aXe of the discharge gas is selected to be 10% or more, 15% or more, 20% or more, or 50% or more according to desired individual specifications. As the Xe proportion aXe of the discharge gas is increased, the ultraviolet ray production efficiency is increased, and the discharge voltages of the reset discharge, the address discharge, and the display discharge are also increased. By taking the above into account, the optimum practical conditions are selected. If the increases in those discharge voltage are permissible, it is possible to use an approximately pure Xe gas (aXe≈100%) positively.

Moreover, the display electrode gap Wgxy is selected to be as great as possible. As a result, the display discharge voltage Vs, more specifically the maximum applied display-discharge voltage Vsemax or the display-discharge dc power supply voltage Vsdc, are selected to be 200 V or more, 220 V or more, 240 V or more, or 260 V or more according to desired individual specifications. However, due to the limitations imposed by the withstand voltages of device structures and their materials, the allowable display discharge voltage Vs is equal to or lower than 1000V.

As described above, the display discharge voltage Vs are increased, and consequently, the display-electrode area Sse in the discharge cell can be reduced, and therefore the light-room contrast can be improved.

First, as in the above discussion (A4), an example of the present embodiment will be explained in terms of the display region surface reflectance β.

Here, in the plasma panel, a surface from which visible light for display is irradiated is called the display surface, and a space into which the visible light for display is irradiated from the display surface is called the viewing space. A space containing plural discharge cells arranged continuously is called the display space, and a projection of the display space onto the display surface is called the display region Rp. The display region surface reflectance β is a ratio averaged over the display region Rp, where white light is entered into the display region Rp from the viewing space, and the ratio is the energy of light emitted from the display region Rp divided by the energy of the incident white light.

In this embodiment, it is desired to satisfy the following inequality:

$$0.02 \leqq \beta \leqq 0.2$$

For improvement of the light-room contrast, it is preferable to make the display region surface reflectance β smaller, but if the display region surface reflectance β is selected to be excessively small, the display luminance itself is lowered, and therefore β is selected to be in the above range.

As will be described later, when reduction in the display region surface reflectance β is realized by reducing the display discharge region area ratio Sd/Sp, or increasing a black region area ratio Sb/Sp, there is a practical lower limit to the display region surface reflectance β, and the above range for the display region surface reflectance β is a practical range. The more preferable range for the display region surface reflectance β is from 0.1 to 0.15.

Next, as in the above discussion (A4), another example of the present embodiment will be explained in terms of the display discharge region area ratio Ad, for improving the light-room contrast by the display region surface reflectance β.

When an area of the display region Rp is Sp, a discharge space used for display is called a display discharge space, a projection of the display discharge space onto the display surface is called the display discharge region, a collection of the display discharge regions in the display region Rp is called a display discharge region collection Rd, an area of the display discharge region collection Rd is Sd, it is desired to satisfy the following inequality:

$$0.05 \leqq Ad \leqq 0.4,$$

where the display discharge region area ratio Ad=Sd/Sp.

If the area Sd of the display discharge region collection Rd is selected to be excessively small, the light emission luminance becomes too low for the display device to function. If the sustain discharge voltage Vs is selected to be sufficiently high, the display discharge region area ratio Ad can be reduced accordingly. In a case where a practical range for the sustain discharge voltage Vs is expressed by $$200\ V \leqq Vs \leqq 1000\ V,$$

a practical range for the display discharge region area ratio Ad is expressed by $$0.05 \leqq Ad \leqq 0.4.$$

Consequently, the display region surface reflectance β can be controlled within the above range. The more preferable range for Ad is from 0.2 to 0.3.

A projection of the discharge cell onto the display surface is called the cell region, and in at least some of the plural discharge cells, and a region other than the display discharge region in the cell region is called a non-display discharge region. When white light is entered into the non-display discharge region from the viewing space, the ratio of the energy of light emitted from the non-display discharge region to the energy of the incident white light may be made 0.2 or less. It is desirable to make the ratio as small as possible, and the practical range for the ratio is from 0.02 to 0.2 in view of the processing temperatures (usually a heat treatment of about 500° C.) and material costs.

The maximum applied display-discharge voltage Vsemax, the display-discharge dc power supply voltage Vsdc, the display discharge region area ratio Ad, and the display region surface reflectance β are selected depending the Xe proportion aXe of the discharge gas and dimensions of the cell structure such as display electrode gap Wgxy.

To realize the above-explained reflectance in the above-mentioned non-display discharge region concretely, in at least some of the discharge cells, the average barrier rib width Wrba is selected to be 0.1 mm or more, 0.15 mm or more, or 0.2 mm or more according to desired individual specifications.

Further, to make the display region surface reflectance β as small as possible, the barrier ribs or barrier rib tops (ends of the barrier ribs on their viewing space sides, i.e. their display-surface-sides) are made of black material, or black layers (usually called black stripes or a black matrix) in the form of and in register with the barrier ribs are provided in spaces displaced toward the viewing space from the barrier ribs. Here the black material and the black layers means material and layers exhibiting the surface reflectance of the above-mentioned values.

Next, another example of the present embodiment which has achieved the above-specified values of the display region surface reflectance β will be explained in terms of the black region area ratio.

Provided in at least some of the plural discharge cells are black regions in which, when white light is entered into the display surface from the viewing space, the ratio of the energy of light emitted from the display surface to the energy of the incident white light is equal to or smaller than 0.2. The black region area ratio Ab satisfies the following inequality:

$$0.95 \geqq Ab \geqq 0.5,$$

where $$Ab = Sb/Sp,$$

Sp is an area of the display region Rp,

Rb denotes a collection of the black regions in the display region Rp, and

Sb is an area of the black region collection Rb in the display surface.

If the area Sb of the black region collection Rb is selected to be excessively large, the light emission luminance becomes too low for the display device to function. If the sustain discharge voltage Vs is selected to be sufficiently high, the black region area ratio Sb/Sp can be increased accordingly. In a case where a practical range for the sustain discharge voltage Vs is expressed by $$200\ V \leqq Vs \leqq 1000\ V,$$

a practical range for the black region area ratio Sb/Sp is expressed by $$0.95 \geqq Sb/Sp \geqq 0.5.$$

The more preferable range for the black region area ratio Sb/Sp is from 0.7 to 0.8.

In this case also, when white light is entered into the black region, the smaller the ratio of the energy of light emitted from the black region to the energy of the incident white light, the better. However, the practical range for the ratio is from 0.02 to 0.2 in view of the processing temperatures (usually a heat treatment of about 500° C.) and material costs.

The following will explain another example of the present embodiment for realizing the above-specified values of the display region surface reflectance β, in which, in at least some of the discharge cells, there are provided a white region RW having a high surface reflectance to white light when viewed from the viewing space and a black region RB having a low surface reflectance to the white light when viewed from the viewing space, and the following conditions are satisfied.

Initially the reflectance is defined as follows: When white light is entered into the display surface from the viewing space, the reflectance is the ratio of the energy of light emitted from the display surface to the energy of the incident white light.

In the present embodiment, at least some of the plural discharge cells are provided with a black region having the reflectance equal to or smaller than 0.5×βmax, where βmax is the maximum of the reflectances in said at least some of the plural discharge cells, and the following conditions are satisfied.

Here, a space containing plural discharge cells arranged continuously is called the display space, a projection of the display space onto the display surface is called the display region Rp, an area of the display region Rp is Sp, a collection of the black regions RB in the display region Rp is denoted by Rb, and an area of the collection Rb of the black regions RB in the display surface is represented by Sb. The black region area ratio Ab=Sb/Sp is selected to satisfy the following inequality:

$$0.95 \geqq Ab \geqq 0.5$$

If the area Sb of the black region collection Rb is selected to be excessively large, the light emission luminance becomes too low for the display device to function. If the sustain discharge voltage Vs is selected to be sufficiently high, the black region area ratio Sb/Sp can be increased accordingly. In a case where a practical range for the sustain discharge voltage Vs is expressed by $$200\ V \leqq Vs \leqq 1000\ V,$$

a practical range for the black region area ratio Sb/Sp is expressed by $$0.95 \geqq Sb/Sp \geqq 0.5.$$

The more preferable range for the black region area ratio Sb/Sp is from 0.7 to 0.8.

For a high-contrast display, it is desirable to make the black region area ratio Ab as small as possible, but its actual value is selected depending upon the Xe proportion aXe of the discharge gas, dimensions of the cell structure such as display electrode gap Wgxy, and the desired luminance value.

Embodiment 2

Figure 10:
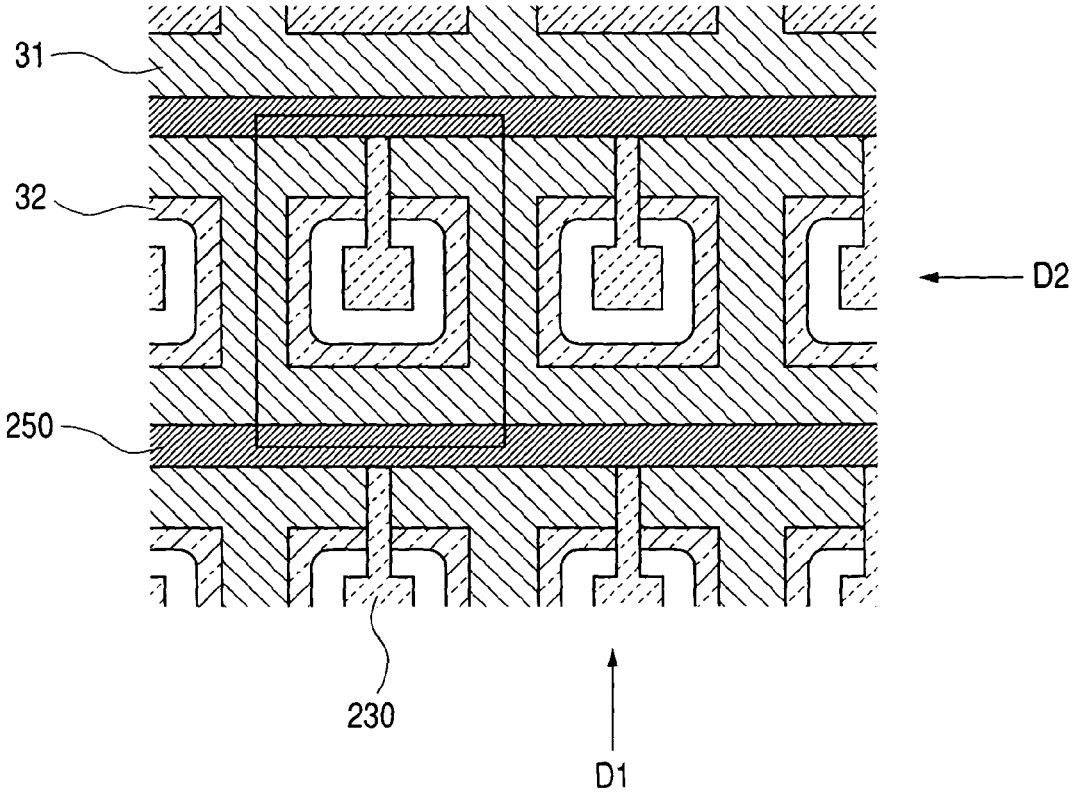
FIG. 10 is a schematic plan view of a basic plasma panel of Embodiment 2 in accordance with the present invention.
Figure 11:
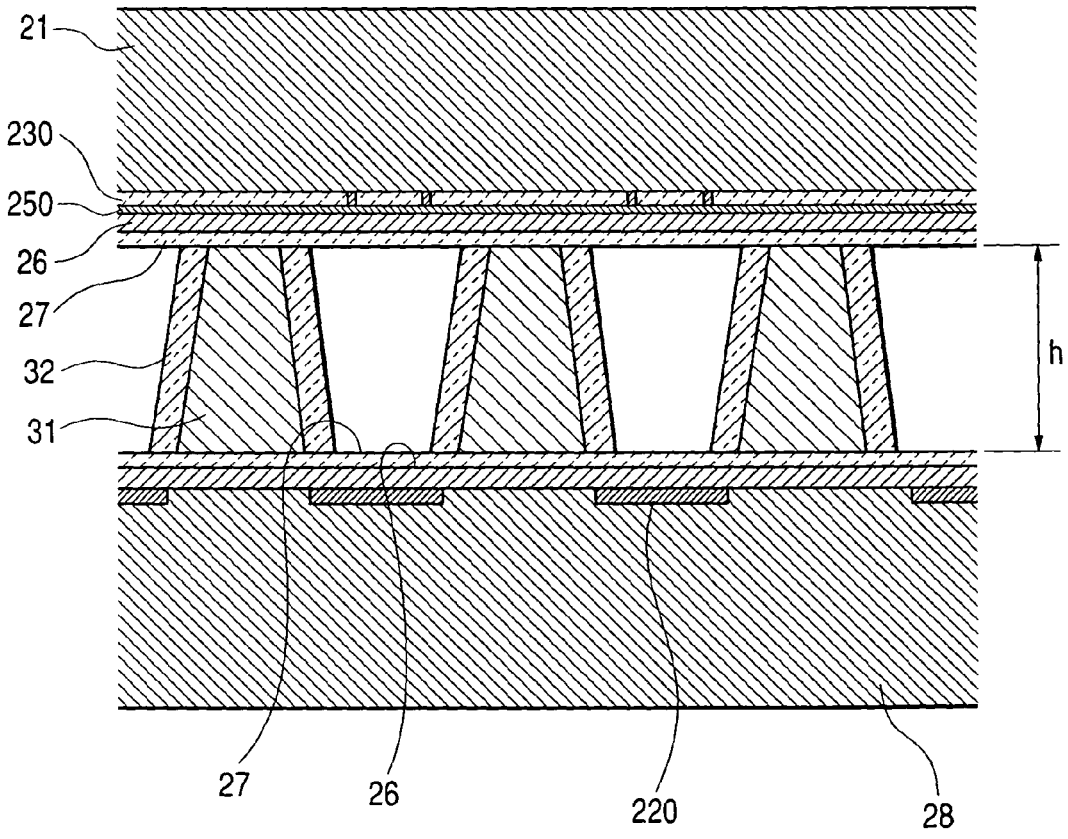
FIG. 11 is a cross-sectional view of Embodiment 2 of FIG. 10 viewed in the direction of the arrow D1 of FIG. 10.
Figure 12:
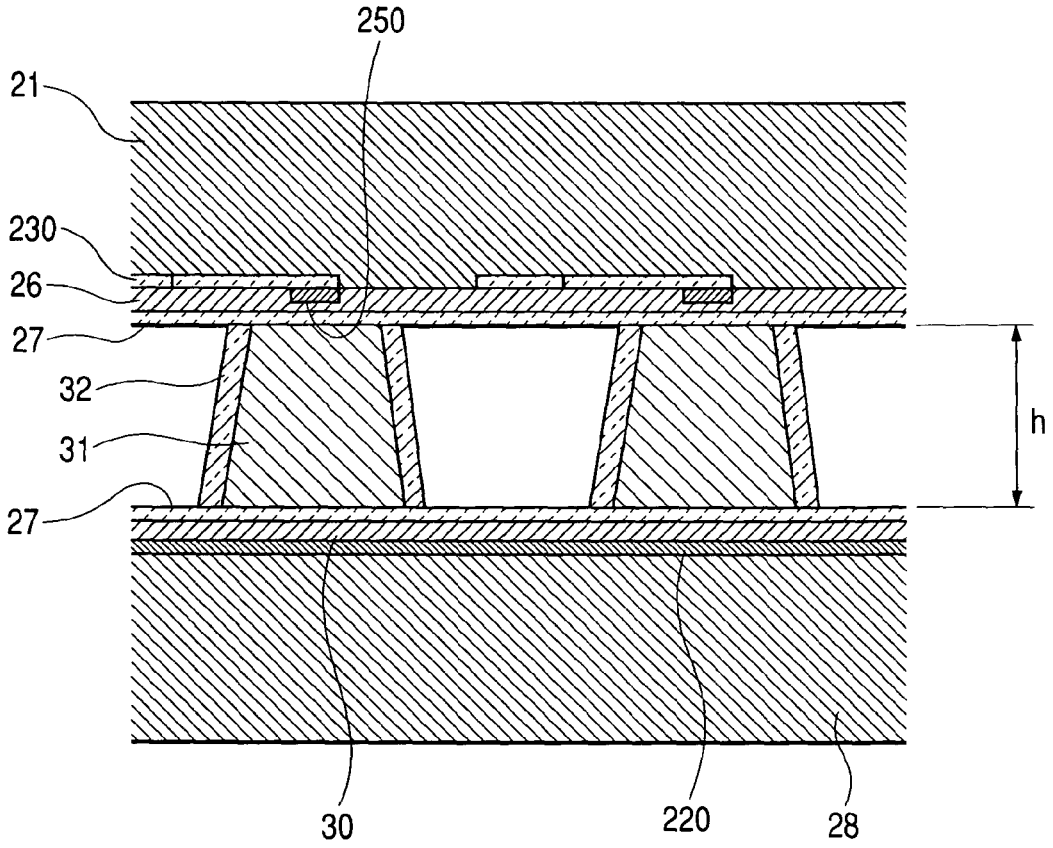
FIG. 12 is a cross-sectional view of Embodiment 2 of FIG. 10 viewed in the direction of the arrow D2 of FIG. 10.

FIG. 10 is a schematic plan view of a basic plasma panel of Embodiment 2 in accordance with the present invention, and illustrates a portion of the basic plasma panel viewed from the viewing space side. FIGS. 11 and 12 are cross-sectional views of Embodiment 2 of FIG. 10 viewed in the directions of the arrows D1 and D2 of FIG. 10, respectively. In the following, the differences between the present Embodiment 2 and Embodiment 1 will be explained.

First, in the present embodiment, the barrier ribs are in the form of boxes. That is to say, the lengthwise directions of the barrier ribs extend in at least two directions DR1 and DR2, which are aligned with the arrows D1 and D2, respectively, in FIG. 10. In a way similar to that explained in connection with Embodiment 1, the average barrier rib width Wrba can be determined in the barrier rib structure having at least two lengthwise directions (DR1 and DR2).

In at least some of the discharge cells, the average barrier rib width Wrba of the barrier ribs with their lengthwise directions aligned in at least one of the above-explained two directions DR1, DR2 are selected to be 0.1 mm or more, 0.15 mm or more, or 0.2 mm or more according to desired individual specifications.

Another feature of the present embodiment is that a pair of display discharge electrodes (the X and Y electrodes) are arranged such that their major surfaces face each other. That is to say, the Y electrodes 230 and the Y bus electrodes 250 are disposed on the front glass substrate 21, and the X electrodes 220 are disposed on the rear glass substrate 28 to face the Y electrodes 250 spaced in the height direction from the X electrodes 220. The X electrodes X 220 disposed on the rear glass substrate 28 does not need to transmit visible light, and does not always need to be transparent electrodes. Both the X and Y electrodes are covered with the dielectric 26 and the protective film 27. The phosphors 32 are coated on the sidewalls of the barrier ribs 31 only, but not on the protective films 27 covering the X and Y electrodes. In FIGS. 11 and 12, the symbol h denotes the cell height, the barrier rib height, or the height of the discharge space.

By arranging the display electrode pair opposite one another across the discharge space in this way, one (the X electrode) of the display discharge electrode pair and the display electrode gap Wgxy do not need to occupy portions of the display region. That is to say, the display discharge region area Sd becomes smaller, and therefore the display discharge region area ratio Ad can be reduced. Consequently, the display region surface reflectance β can be reduced easily.

As explained in connection with FIGS. 9A and 9B, it is necessary for increasing the ultraviolet ray production efficiency to increase the product pd in discharge. In the present embodiment, the distance d between the discharge electrodes is the discharge space height h. For obtaining an adequate ultraviolet ray production efficiency, the discharge space height h needs to be selected to be 0.2 mm or more, 0.4 mm or more, 0.6 mm or more, or 1.0 mm or more according to desired individual specifications. The greater the discharge space height h, the higher the ultraviolet ray production efficiency. On the other hand, the barrier rib having a higher barrier rib aspect ratio Arbas will have to be formed with increasing discharge space height, resulting in increase in manufacturing cost. The barrier rib aspect ratio Arbas is defined as h/Wrba.

The discharge space height h is realized by the structure explained below, for example. The z axis is drawn in the direction of the height of the plasma panel. When zX is the z-axis coordinate of the X electrode which is one of the display electrode pair, zY is the z-axis coordinate of the Y electrode, the absolute value $|zY-zX|$ of a difference between the z-axis coordinates zX and ZY needs to be selected to be 0.2 mm or more, 0.4 mm or more, 0.6 mm or more, or 1.0 mm or more according to desired individual specifications.

Further, when the discharge space height h is increased, the discharge space aspect ratio Adsas=h/Wdsa also increases. When the discharge space aspect ratio Adsas is increased, visible light generated by the phosphors 32 enters the viewing space after multiple reflections by the surfaces of the phosphors 32 or the surfaces of the protective film 27 on the rear substrate (or the surface of the dielectric 26 on the rear substrate). Therefore it is necessary for effective utilization of the visible light to increase the surface reflectance of the surfaces of the phosphors 32 or the surfaces of the protective film 27 on the rear substrate (or the surface of the dielectric 26 on the rear substrate), and this surface reflectance is called the non-aperture-surface surface reflectance.

The non-aperture-surface surface reflectance is usually about 60%, and it is preferable to select the non-aperture-surface surface reflectance to be 80% or more, or 90% or more according to desired individual specifications. The greater the discharge space height h is selected to be, the higher the non-aperture-surface surface reflectance needs to be.

The non-aperture-surface surface reflectance is defined as follows. In the discharge cell, the solid wall surrounding the display discharge space is called the inner surface of the display discharge space, a portion of the inner surface of the display discharge space from which the visible light for a display is emitted into the viewing space is called the aperture surface, and a portion of the inner surface of the display discharge space other than the aperture surface is called the non-aperture-surface. The non-aperture-surface surface reflectance is defined as a surface reflectance of the non-aperture-surface averaged over the non-aperture-surface.

The present invention is capable of realizing a plasma display device having a high set-luminous-efficacy (i.e. producing a high-brightness display image at a low power consumption) and exhibiting a high light-room contrast.

What is claimed is:

1. A plasma display device comprising a plasma panel and a driving circuit for driving said plasma panel, said plasma panel being provided with a plurality of discharge cells, each of said plurality of discharge cells comprising:

at least an X electrode and a Y electrode for producing a display discharge;

a dielectric film for covering said X electrode and said Y electrode at least partially;

a discharge gas filled in a discharge space; and a phosphor for emitting visible light by being excited by ultraviolet rays produced by discharge of said discharge gas, wherein Vsemax is in a range of from 200 V to 1000 V, where Vsemax is a maximum of an absolute value of a voltage difference between said X electrode and said Y electrode during a display period when display-discharge pulses are applied to said X electrode and said Y electrode for producing said display discharge;

wherein in said plasma panel, a display discharge region area ratio Ad satisfies $$0.05 \leqq Ad \leqq 0.4,$$

where, in said plasma panel, a display surface is a surface from which visible light for display is irradiated, a viewing space is a space into which the visible light for display is irradiated from said display surface, a display space is a space containing said plurality of discharge cells arranged continuously, a display region Rp is a projection of said display space onto said display surface, Sp is an area of said display region Rp, a display discharge space is a portion of said discharge space where said display discharge is produced, a display discharge region is a projection of said display discharge space onto said display surface, Rd denotes a collection of said display discharge regions in said display region Rp, Sd is an area of said collection Rd; and Ad=Sd/Sp; and wherein in at least some of said plurality of discharge cells, a ratio of an energy of light emitted from a non-display discharge region to an energy of white light is equal to or smaller than 0.2 when said white light is entered into said non-display discharge region from said viewing space, where a cell region is a projection of one of said plurality of discharge cells onto said display surface, and a non-display discharge region is a portion of said cell region other than said display discharge region.

2. A plasma display device according to claim 1, wherein said driving circuit comprises a dc power supply for outputting a plurality of voltages including ground potential for forming said display-discharge pulses, and a switch circuit coupled between said dc power supply and said X and Y electrodes, and Vsdc is in a range of from 200 V to 1000 V, where Vsdc is defined as an absolute value of a voltage difference between maximum and minimum voltages of said plurality of voltages outputted during said display period.

3. A plasma display device according to claim 1, wherein said discharge gas contains a Xe gas of a proportion aXe equal to or greater than 0.1, where ng is a volume particle (atom or molecule) density of said discharge gas, nXe is a volume particle density of said Xe gas, and aXe=nXe/ng.

4. A plasma display device according to claim 1, further comprising a plurality of barrier ribs, wherein said plurality of barrier ribs extend in approximately one direction, are arranged in a direction perpendicular to said one direction, and form part of said plurality of discharge cells, and in at least some of said discharge cells, an average width of said plurality of barrier ribs averaged over a height thereof is 0.1 mm or more.

5. A plasma display device according to claim 1, further comprising a plurality of barrier ribs, wherein said plurality of barrier ribs extend in two directions intersecting each other in a grid pattern, and form part of said plurality of discharge cells, and in at least some of said discharge cells, an average width of said plurality of barrier ribs averaged over a height thereof is 0.1 mm or more in said plurality of barrier ribs extending in at least one of said two directions.

6. A plasma display device according to claim 5, wherein an absolute value $|zY-zX|$ is 0.2 mm or more, when a z axis is drawn in a direction of a height of said plurality of barrier ribs, zX is a z-axis coordinate of said X electrode, zY is a z-axis coordinate of said Y electrode.

7. A plasma display device according to claim 6, wherein a non-aperture-surface surface reflectance is 80% or more, where a solid wall surrounding said display discharge space is called an inner surface of said display discharge space, a portion of said inner surface of said display discharge space from which the visible light for a display is emitted into said viewing space is called an aperture surface, a portion of said inner surface of said display discharge space other than said aperture surface is called a non-aperture-surface, said non-aperture-surface surface reflectance is defined as a surface reflectance of said non-aperture-surface averaged over said non-aperture-surface.

8. An image display system employing a plasma display device according to claim 1.

9. A plasma display device comprising a plasma panel and a driving circuit for driving said plasma panel, said plasma panel being provided with a plurality of discharge cells, each of said plurality of discharge cells comprising:

at least an X electrode and a Y electrode for producing a display discharge;

a dielectric film for covering said X electrode and said Y electrode at least partially;

a discharge gas filled in a discharge space; and a phosphor for emitting visible light by being excited by ultraviolet rays produced by discharge of said discharge gas, wherein Vsemax is in a range of from 200 V to 1000 V, where Vsemax is a maximum of an absolute value of a voltage difference between said X electrode and said Y electrode during a display period when display-discharge pulses are applied to said X electrode and said Y electrode for producing said display discharge;

wherein at least some of said plurality of discharge cells are provided with a black region in which a ratio of an energy of light emitted from a display surface to an energy of white light entered into said display surface is equal to or smaller than 0.2 when said white light is entered into said display surface from a viewing_space, where said display surface is a surface from which visible light for display is irradiated, and said viewing space is a space into which the visible light for display is irradiated from said display surface, wherein a black region area ratio Ab satisfies the following inequality:

$$0.95 \geqq Ab \geqq 0.5,$$

where a display space is a space containing said plurality of discharge cells arranged continuously, a display region Rp is a projection of said display space onto said display surface, Sp is an area of said display region Rp, Rb denotes a collection of said black regions in said display region Rp, Sb is an area of said black region collection Rb in said display surface, and $$Ab = Sb/Sp.$$

10. A plasma display device according to claim 9, wherein said driving circuit comprises a dc power supply for outputting a plurality of voltages including ground potential for forming said display-discharge pulses, and a switch circuit coupled between said dc power supply and said X and Y electrodes, and Vsdc is in a range of from 200 V to 1000 V, where Vsdc is defined as an absolute value of a voltage difference between maximum and minimum voltages of said plurality of voltages outputted during said display period.

11. A plasma display device according to claim 9, wherein said discharge gas contains a Xe gas of a proportion axe equal to or greater than 0.1, where ng is a volume particle (atom or molecule) density of said discharge gas, nXe is a volume particle density of said Xe gas, and aXe=nXe/ng.

12. A plasma display device according to claim 9, further comprising a plurality of barrier ribs, wherein said plurality of barrier ribs extend in approximately one direction, are arranged in a direction perpendicular to said one direction, and form part of said plurality of discharge cells, and in at least some of said discharge cells, an average width of said plurality of barrier ribs averaged over a height thereof is 0.1 mm or more.

13. A plasma display device according to claim 9, further comprising a plurality of barrier ribs, wherein said plurality of barrier ribs extend in two directions intersecting each other in a grid pattern, and form part of said plurality of discharge cells, and in at least some of said discharge cells, an average width of said plurality of barrier ribs averaged over a height thereof is 0.1 mm or more in said plurality of barrier ribs extending in at least one of said two directions.

14. A plasma display device according to claim 13, wherein an absolute value $|zY-zX|$ is 0.2 mm or more, when a z axis is drawn in a direction of a height of said plurality of barrier ribs, zX is a z-axis coordinate of said X electrode, zY is a z-axis coordinate of said Y electrode.

15. A plasma display device according to claim 14, wherein a non-aperture-surface surface reflectance is 80% or more, where a solid wall surrounding said display discharge space is called an inner surface of said display discharge space, a portion of said inner surface of said display discharge space from which the visible light for a display is emitted into said viewing space is called an aperture surface, a portion of said inner surface of said display discharge space other than said aperture surface is called a non-aperture-surface, said non-aperture-surface surface reflectance is defined as a surface reflectance of said non-aperture-surface averaged over said non-aperture-surface.

16. An image display system employing a plasma display device according to claim 9.

17. A plasma display device comprising a plasma panel and a driving circuit for driving said plasma panel, said plasma panel being provided with a plurality of discharge cells, each of said plurality of discharge cells comprising:

at least an X electrode and a Y electrode for producing a display discharge;

a dielectric film for covering said X electrode and said Y electrode at least partially;

a discharge gas filled in a discharge space; and a phosphor for emitting visible light by being excited by ultraviolet rays produced by discharge of said discharge gas, wherein Vsemax is in a range of from 200 V to 1000 V, where Vsemax is a maximum of an absolute value of a voltage difference between said X electrode and said Y electrode during a display period when display-discharge pulses are applied to said X electrode and said Y electrode for producing said display discharge;

wherein at least some of said plurality of discharge cells are provided with a black region of reflectance equal to or lower than $0.5 \times \beta max$, where, in said plasma panel, a display surface is a surface from which visible light for display is irradiated, and a viewing space is a space into which the visible light for display is irradiated from said display surface, a reflectance is a ratio of an energy of light emitted from said display surface to an energy of white light entered into said display surface when said white light is entered into said display surface from said viewing space, and βmax is a maximum of said reflectance in a respective one of said at least some of said plurality of discharge cells, and wherein a black region area ratio Ab satisfies the following inequality:

$$0.95 \geqq Ab \geqq 0.5,$$

where a display space is a space containing said plurality of discharge cells arranged continuously, a display region Rp is a projection of said display space onto said display surface, Sp is an area of said display region Rp, Rb denotes a collection of said black regions in said display region Rp, Sb is an area of said black region collection Rb in said display surface, and $$Ab = Sb/Sp.$$

18. A plasma display device according to claim 17, wherein said driving circuit comprises a dc power supply for outputting a plurality of voltages including ground potential for forming said display-discharge pulses, and a switch circuit coupled between said dc power supply and said X and Y electrodes, and Vsdc is in a range of from 200 V to 1000 V, where Vsdc is defined as an absolute value of a voltage difference between maximum and minimum voltages of said plurality of voltages outputted during said display period.

19. A plasma display device according to claim 17, wherein said discharge gas contains a Xe gas of a proportion aXe equal to or greater than 0.1, where ng is a volume particle (atom or molecule) density of said discharge gas, nXe is a volume particle density of said Xe gas, and aXe=nXe/ng.

20. A plasma display device according to claim 17, further comprising a plurality of barrier ribs, wherein said plurality of barrier ribs extend in approximately one direction, are arranged in a direction perpendicular to said one direction, and form part of said plurality of discharge cells, and in at least some of said discharge cells, an average width of said plurality of barrier ribs averaged over a height thereof is 0.1 mm or more.

21. A plasma display device according to claim 3, further comprising a plurality of barrier ribs, wherein said plurality of barrier ribs extend in two directions intersecting each other in a grid pattern, and form part of said plurality of discharge cells, and in at least some of said discharge cells, an average width of said plurality of barrier ribs averaged over a height thereof is 0.1 mm or more in said plurality of barrier ribs extending in at least one of said two directions.

22. A plasma display device according to claim 21, wherein an absolute value $|zY-zX|$ is 0.2 mm or more, when a z axis is drawn in a direction of a height of said plurality of barrier ribs, zX is a z-axis coordinate of said X electrode, zY is a z-axis coordinate of said Y electrode.

23. A plasma display device according to claim 22, wherein a non-aperture-surface surface reflectance is 80% or more, where a solid wall surrounding said display discharge space is called an inner surface of said display discharge space, a portion of said inner surface of said display discharge space from which the visible light for a display is emitted into said viewing space is called an aperture surface, a portion of said inner surface of said display discharge space other than said aperture surface is called a non-aperture-surface, said non-aperture-surface surface reflectance is defined as a surface reflectance of said non-aperture-surface averaged over said non-aperture-surface.

24. An image display system employing a plasma display device according to claim 17.

25. A plasma display device comprising a plasma panel and a driving circuit for driving said plasma panel, said plasma panel being provided with a plurality of discharge cells, each of said plurality of discharge cells comprising:

at least an X electrode and a Y electrode for producing a display discharge;

a dielectric film for covering said X electrode and said Y electrode at least partially;

a discharge gas filled in a discharge space; and a phosphor for emitting visible light by being excited by ultraviolet rays produced by discharge of said discharge gas, wherein Vsemax is in a range of from 200 V to 1000 V, where Vsemax is a maximum of an absolute value of a voltage difference between said X electrode and said Y electrode during a display period when display-discharge pulses are applied to said X electrode and said Y electrode for producing said display discharge;

wherein an average reflectance β satisfies $$0.02 \leqq \beta \leqq 0.2,$$

where, in said plasma panel, a display surface is a surface from which visible light for display is irradiated, a viewing space is a space into which the visible light for display is irradiated from said display surface, a display space is a space containing said plurality of discharge cells arranged continuously, a display region Rp is a projection of said display space onto said display surface, a reflectance is a ratio of an energy of light emitted from said display region Rp to an energy of white light entered into said display region Rp when said white light is entered into said display region Rp from said viewing space, and an average reflectance β is said reflectance averaged over said display region.

26. A plasma display device according to claim 25, wherein said driving circuit comprises a dc power supply for outputting a plurality of voltages including ground potential for forming said display-discharge pulses, and a switch circuit coupled between said dc power supply and said X and Y electrodes, and Vsdc is in a range of from 200 V to 1000 V, where Vsdc is defined as an absolute value of a voltage difference between maximum and minimum voltages of said plurality of voltages outputted during said display period.

27. A plasma display device according to claim 25, wherein said discharge gas contains a Xe gas of a proportion aXe equal to or greater than 0.1, where ng is a volume particle (atom or molecule) density of said discharge gas, nXe is a volume particle density of said Xe gas, and aXe=nXe/ng.

28. A plasma display device according to claim 25, further comprising a plurality of barrier ribs, wherein said plurality of barrier ribs extend in approximately one direction, are arranged in a direction perpendicular to said one direction, and form part of said plurality of discharge cells, and in at least some of said discharge cells, an average width of said plurality of barrier ribs averaged over a height thereof is 0.1 mm or more.

29. A plasma display device according to claim 25, further comprising a plurality of barrier ribs, wherein said plurality of barrier ribs extend in two directions intersecting each other in a grid pattern, and form part of said plurality of discharge cells, and in at least some of said discharge cells, an average width of said plurality of barrier ribs averaged over a height thereof is 0.1 mm or more in said plurality of barrier ribs extending in at least one of said two directions.

30. A plasma display device according to claim 29, wherein an absolute value $|zY-zX|$ is 0.2 mm or more, when a z axis is drawn in a direction of a height of said plurality of barrier ribs, zX is a z-axis coordinate of said X electrode, zY is a z-axis coordinate of said Y electrode.

31. A plasma display device according to claim 30, wherein a non-aperture-surface surface reflectance is 80% or more, where a solid wall surrounding said display discharge space is called an inner surface of said display discharge space, a portion of said inner surface of said display discharge space from which the visible light for a display is emitted into said viewing space is called an aperture surface, a portion of said inner surface of said display discharge space other than said aperture surface is called a non-aperture-surface, said non-aperture-surface surface reflectance is defined as a surface reflectance of said non-aperture-surface averaged over said non-aperture-surface.

32. An image display system employing a plasma display device according to claim 25.

* * * * *